US007893917B2

(12) United States Patent
Baba et al.

(10) Patent No.: US 7,893,917 B2
(45) Date of Patent: Feb. 22, 2011

(54) IMAGE DISPLAY APPARATUS AND IMAGE DISPLAY METHOD

(75) Inventors: Masahiro Baba, Yokohama (JP); Goh Itoh, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 827 days.

(21) Appl. No.: 11/856,253

(22) Filed: Sep. 17, 2007

(65) Prior Publication Data

US 2008/0074372 A1 Mar. 27, 2008

(30) Foreign Application Priority Data

Sep. 21, 2006 (JP) ..... 2006-256087

(51) Int. Cl.
*G09G 3/36* (2006.01)

(52) U.S. Cl. ..... 345/102; 345/690

(58) Field of Classification Search ..... 345/87–102, 345/204–211, 690–693; 348/671–673
See application file for complete search history.

(56) References Cited

U.S. PATENT DOCUMENTS

| | | | | |
|---|---|---|---|---|
| 7,443,377 | B2 * | 10/2008 | Kim | 345/102 |
| 7,522,135 | B2 * | 4/2009 | Baik | 345/88 |
| 7,659,880 | B2 * | 2/2010 | Miyazawa | 345/102 |
| 2002/0003522 | A1 | 1/2002 | Baba et al. | |
| 2004/0201562 | A1 * | 10/2004 | Funamoto et al. | 345/89 |
| 2004/0257329 | A1 * | 12/2004 | Park et al. | 345/102 |
| 2006/0221046 | A1 * | 10/2006 | Sato et al. | 345/102 |
| 2006/0238487 | A1 * | 10/2006 | Shih | 345/102 |
| 2007/0001997 | A1 * | 1/2007 | Kim et al. | 345/102 |
| 2007/0268242 | A1 * | 11/2007 | Baba et al. | 345/102 |
| 2007/0285379 | A1 * | 12/2007 | Jung et al. | 345/102 |
| 2009/0002285 | A1 * | 1/2009 | Baba et al. | 345/77 |

FOREIGN PATENT DOCUMENTS

| | | |
|---|---|---|
| JP | 2003-036063 | 2/2003 |
| JP | 2004-258669 | 9/2004 |
| JP | 2005-148709 | 6/2005 |

* cited by examiner

*Primary Examiner*—Alexander Eisen
*Assistant Examiner*—Patrick Marinelli
(74) *Attorney, Agent, or Firm*—Turocy & Watson, LLP

(57) ABSTRACT

There is provided with an image display method including: creating a histogram indicating frequencies of pixels included in level-ranges associated with representative gray-scale levels; calculating differences between first brightnesses each predetermined for the each representative gray-scale level and second brightnesses each preliminarily obtained for the each representative gray-scale level displayed on an image display with each of a plurality of light-source levels of light-source luminance, accumulating, for each of the representative gray-scale levels, products of the differences by the frequency, selecting a selected light-source level having the smallest accumulated sum or the smaller accumulated sum than a threshold value; providing signals of one frame of an input video image to a light modulation device that displays an image by modulating a transmittance or a reflectance of light from a light source, and controlling so that the light source emits light in luminance corresponding to the selected light-source level.

27 Claims, 23 Drawing Sheets

| GRAY-SCALE LEVEL x | BRIGHTNESS G(x) |
|---|---|
| 0 | 0.000000 |
| 1 | 0.000005 |
| 2 | 0.000023 |
| 3 | 0.000057 |
| ⋮ | ⋮ |
| 252 | 0.974300 |
| 253 | 0.982826 |
| 254 | 0.991393 |
| 255 | 1.000000 |

| GRAY-SCALE LEVEL x | BRIGHTNESS g (x, 0.1) | BRIGHTNESS g (x, 0.2) | BRIGHTNESS g (x, 0.3) | | BRIGHTNESS g (x, 0.9) | BRIGHTNESS g (x, 1.0) |
|---|---|---|---|---|---|---|
| 0 | 0.000400 | 0.000800 | 0.001200 | | 0.003600 | 0.004000 |
| 1 | 0.000401 | 0.000801 | 0.001202 | | 0.003605 | 0.004005 |
| 2 | 0.000402 | 0.000805 | 0.001207 | | 0.003621 | 0.004023 |
| 3 | 0.000406 | 0.000811 | 0.001217 | | 0.003651 | 0.004057 |
| | | | | | | |
| 252 | 0.097440 | 0.194881 | 0.292321 | | 0.876963 | 0.974403 |
| 253 | 0.098289 | 0.196579 | 0.294868 | | 0.884605 | 0.982895 |
| 254 | 0.099143 | 0.198285 | 0.297428 | | 0.892285 | 0.991427 |
| 255 | 0.100000 | 0.200000 | 0.300000 | | 0.900000 | 1.000000 |

FIG. 7

| GRAY-SCALE LEVEL x | BRIGHTNESS g (x, 1.0) |
|---|---|
| 0 | 0.004000 |
| 1 | 0.004005 |
| 2 | 0.004023 |
| 3 | 0.004057 |
| ⋮ | ⋮ |
| 252 | 0.974403 |
| 253 | 0.982895 |
| 254 | 0.991427 |
| 255 | 1.000000 |

FIG. 8

| GRAY-SCALE LEVEL x | BRIGHTNESS DIFFERENCE \| G(x)-g(x, 0.1) \| | BRIGHTNESS DIFFERENCE \| G(x)-g(x, 0.2) \| | BRIGHTNESS DIFFERENCE \| G(x)-g(x, 0.3) \| | | BRIGHTNESS DIFFERENCE \| G(x)-g(x, 0.9) \| | BRIGHTNESS DIFFERENCE \| G(x)-g(x, 1.0) \| |
|---|---|---|---|---|---|---|
| 0 | 0.000400 | 0.000800 | 0.001200 | | 0.003600 | 0.004000 |
| 1 | 0.000395 | 0.000796 | 0.001196 | | 0.003599 | 0.004000 |
| 2 | 0.000379 | 0.000781 | 0.001184 | | 0.003598 | 0.004000 |
| 3 | 0.000394 | 0.000754 | 0.001160 | | 0.003594 | 0.004000 |
| | | | | | | |
| 252 | 0.974300 | 0.876860 | 0.779420 | | 0.097338 | 0.000103 |
| 253 | 0.982826 | 0.884537 | 0.786247 | | 0.098221 | 0.000069 |
| 254 | 0.991393 | 0.892250 | 0.793107 | | 0.099108 | 0.000034 |
| 255 | 1.000000 | 0.900000 | 0.800000 | | 0.100000 | 0.000000 |

FIG. 9

| INPUT GRAY-SCALE LEVEL x | OUTPUT GRAY-SCALE LEVEL f(x, 0.1) | OUTPUT GRAY-SCALE LEVEL f(x, 0.2) | OUTPUT GRAY-SCALE LEVEL f(x, 0.3) | | OUTPUT GRAY-SCALE LEVEL f(x, 0.9) | OUTPUT GRAY-SCALE LEVEL f(x, 1.0) |
|---|---|---|---|---|---|---|
| 0 | 0 | 0 | 0 | | 0 | 0 |
| 1 | 1 | 1 | 1 | | 1 | 1 |
| 2 | 3 | 3 | 2 | | 2 | 2 |
| 3 | 4 | 4 | 4 | | 3 | 3 |
| | | | | | | |
| 252 | 254 | 253 | 253 | | 252 | 252 |
| 253 | 254 | 254 | 254 | | 253 | 253 |
| 254 | 255 | 254 | 254 | | 254 | 254 |
| 255 | 255 | 255 | 255 | | 255 | 255 |

FIG. 13

| INPUT GRAY-SCALE LEVEL x | OUTPUT GRAY-SCALE LEVEL $f_0(x)$ | OUTPUT GRAY-SCALE LEVEL $f_1(x)$ | OUTPUT GRAY-SCALE LEVEL $f_2(x)$ | | OUTPUT GRAY-SCALE LEVEL $f_8(x)$ | OUTPUT GRAY-SCALE LEVEL $f_9(x)$ |
|---|---|---|---|---|---|---|
| 0 | 0 | 0 | 0 | | 0 | 0 |
| 1 | 1 | 1 | 1 | | 1 | 1 |
| 2 | 3 | 3 | 2 | | 2 | 2 |
| 3 | 4 | 4 | 4 | | 3 | 3 |
| | | | | | | |
| 252 | 254 | 253 | 253 | | 252 | 252 |
| 253 | 254 | 254 | 254 | | 253 | 253 |
| 254 | 255 | 254 | 254 | | 254 | 254 |
| 255 | 255 | 255 | 255 | | 255 | 255 |

FIG. 19

IMAGE DISPLAY APPARATUS AND IMAGE DISPLAY METHOD

CROSS-REFERENCE TO RELATED APPLICATIONS

This application is based upon and claims the benefit of priority from the prior Japanese Patent Applications No. 2006-256087 filed on Sep. 21, 2006, the entire contents of which are incorporated herein by reference.

BACKGROUND OF THE INVENTION

1. Field of the Invention

The present invention relates to an image display apparatus and method that can enhance the visual contrast of a display video image.

2. Related Art

In recent years, an image display apparatus, which is exemplified by a liquid-crystal display device, provided with a light source and a light modulation device that modulates light from the light source has widely spread. However, in such an image display apparatus as described above, the light modulation device does not have an ideal modulation characteristic; therefore, especially when a black image is displayed, light leakage from the light modulation device causes deterioration in the contrast of the displayed image.

In order to suppress the deterioration in the contrast, a plurality of methods, in which the luminance of the light source is modulated according to an input video image, has been proposed. For example, according to JP-A2005-148709 (Kokai), the modal value or the average value of gray-scale levels of an input video image is obtained, and based on the modal value or the average value, the luminance of the light source is controlled. Additionally, according to Japanese Patent No. 3583124, the peak value or the average value of gray-scale levels of an input video image is obtained, and based on the peak value and the average value, the luminance of the light source is controlled. Additionally, according to Japanese Patent No. 3495362, the average value of gray-scale levels of an input video image is obtained, and based on the average value, the luminance of the light source is controlled.

By controlling the light-source luminance in accordance with an input video image, all the foregoing techniques can enhance the contrast, compared with an image display apparatus having a constant light-source luminance. All the foregoing techniques control the light-source luminance, based on a representative value such as the average value, the modal value, or the peak value of the gray-scale levels of an input video image. However, a great number of video images exist in which, even though the foregoing representative values are the same, the respective distributions of the gray-scale levels differ from one another; In each of the foregoing techniques, the same light-source luminance is set for all the video images; therefore, in some cases, the contrast in an input video image cannot sufficiently be obtained.

SUMMARY OF THE INVENTION

According to an aspect of the present invention, there is provided with an image display apparatus comprising: an image display, a histogram creation unit, a light-source-luminance calculator, and a control unit. The image display includes a light source whose light-source luminance is adjustable and a light modulation device that displays an image by modulating a transmittance or a reflectance of light from the light source, based on signals representing the image. The histogram creation unit creates a histogram from one frame of an input video image, the histogram indicating frequencies of pixels included in level-ranges associated with representative gray-scale levels. The light-source-luminance calculator includes a difference calculation unit, a difference accumulating unit and a light-source-luminance selection unit. The difference calculation unit calculates differences between first brightnesses each predetermined for the each representative gray-scale level and second brightnesses each preliminarily obtained for the each representative gray-scale level displayed on the image display with each of a plurality of light-source levels of the light-source luminance. The difference accumulating unit accumulates, for each of the representative gray-scale levels, products of the differences by the frequency. The light-source-luminance selection unit selects a selected light-source level having the smallest accumulated sum or the smaller accumulated sum than a threshold value. The control unit provides signals of the one frame of the input video image to the light modulation device and control so that the light source emits light in luminance corresponding to the selected light-source level.

According to an aspect of the present invention, there is provided with a image display method comprising the steps of: creating a histogram, calculating differences between first and second brightnesses for each of a plurality of light-source levels of light-source luminance, accumulating products of the differences by the frequency, selecting a selected light-source level, providing signals of the one frame of the input video image to a light modulation device, and controlling the light-source. The histogram is created from one frame of an input video image and the histogram indicates frequencies of pixels included in level-ranges associated with representative gray-scale levels. The first brightnesses are each predetermined for the each representative gray-scale level and the second brightnesses are each preliminarily obtained for the each representative gray-scale level displayed on an image display with each of a plurality of light-source levels of light-source luminance. The products of the differences by the frequency are accumulated for each of the representative gray-scale levels. The selected light-source level has the smallest accumulated sum or the smaller accumulated sum than a threshold value. The light modulation device displays an image by modulating a transmittance or a reflectance of light from a light source based on signals representing the image. The light source is controlled so as to emit light in luminance corresponding to the selected light-source level. The light-source luminance of the light source is adjustable.

BRIEF DESCRIPTION OF THE DRAWINGS

FIG. 7 is a table representing an example of table data in which the gray-scale level "x" and the brightness g(x, I) are related to each other;

FIG. 8 is a table representing an example of table data retaining only the gray-scale level vs. brightness characteristic in the case where the backlight-luminance is $I_{max}$ (=1.0);

FIG. 9 is a table representing an example of table data in which the gray-scale level "x" and the absolute value of the difference between G(x) and g(x, I) are related to each other, for each backlight-luminance;

FIG. 13 is a table representing an example of table data in which the input gray-scale level "x" and the output gray-scale level f(x, I) are related to each other;

FIG. 19 is a table representing an example of table data in which the input gray-scale level "x" and the output gray-scale level $f_i(x)$ are related to each other;

DETAILED DESCRIPTION OF THE INVENTION

Embodiment 1

Figure 1:
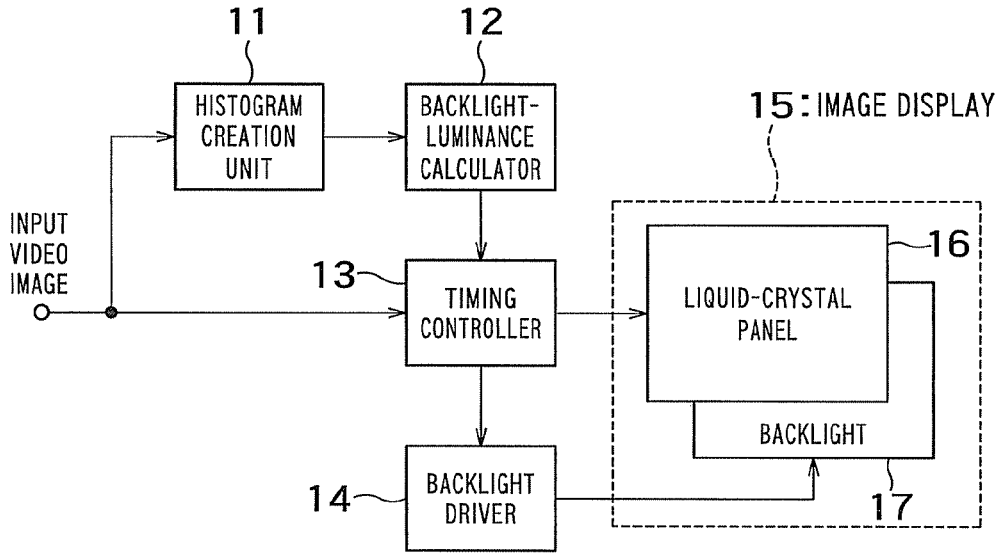
FIG. 1 is a diagram illustrating the configuration of an image display apparatus according to Embodiment 1.

FIG. 1 is a diagram illustrating the configuration of an image display apparatus according to Embodiment 1 of the present invention. The image display apparatus according to Embodiment 1 is configured with a histogram creation unit 11, a backlight-luminance calculator (light-source-luminance calculator) 12, a timing controller (control unit) 13, a backlight driver 14, and an image display 15; the image display 15 is a liquid-crystal display configured with a liquid-crystal panel 16 as a light modulation device and a backlight 17, as a light source, which is disposed behind the liquid-crystal panel 16. An input video image is inputted to the histogram creation unit 11 and the timing controller 13. Based on the input video image, the histogram creation unit 11 counts, every predetermined gray-scale level, the number of pixels included in the respective level-ranges so as to create a histogram that makes the gray-scale level representative of each level-range and the number of pixels (the number of pixels exemplifies the frequency of a pixel) included in that level-range correspond to each other. The backlight-luminance calculator 12 calculates the light-emission luminance (light-source luminance) of the backlight 17, based on the histogram created in the histogram creation unit 11. The timing controller 13 adjusts the synchronization between the input video image and the backlight luminance calculated by the backlight-luminance calculator 12; the input video image is transmitted, along with a synchronization signal for driving the liquid-crystal panel 16, to the liquid-crystal panel 16, and the backlight luminance is transmitted to the backlight driver 14. Based on the inputted backlight luminance, the backlight driver 14 creates a backlight drive signal, for actually driving and controlling the backlight 17, which is transmitted to the backlight 17. In the last place, the input video image is written in the liquid-crystal panel 16; at the same time, based on the backlight drive signal outputted from the backlight driver 14, the backlight 17 emits light, so that an image is displayed on the liquid-crystal panel 16.

Next, the details of the operation of each unit will be explained.

(Histogram Creation Unit 11)

With regard to one frame (input image) of input video images, the histogram creation unit 11 counts, every predetermined gray-scale level, the number of pixels (the frequency of a pixel) included in the respective level-ranges so as to create a so-called histogram. In addition, instead of the number of pixels, the frequency in the histogram may be a value normalized to the total pixel number given as follows:

$$h_n(x) = \frac{h(x)}{\sum_{i=0}^{255} h(i)} \quad \text{[Formula 1]}$$

where $h_n(x)$ is the frequency, of the gray-scale level "x", normalized to the total pixel number, and h(x) is the frequency of the gray-scale level "x". In addition, the configuration may be in such a way that the weight to the frequency is taken into consideration.

$$h_\alpha(x)=h(x)^\alpha \quad \text{[Formula 2]}$$

where $h_\alpha(x)$ is a value obtained by raising the frequency h(x) of the gray-scale level "x" to the α-th power, while letting "α" denote the weight. By making "α" to be a value between zero and one, $h_\alpha(x)$ having a relatively small difference between the low frequency and the high frequency can be obtained. The type of the input video image can be assumed in various manners; however, in Embodiment 1, the input video image is configured with three channels, i.e., the red, green, and blue channels, and the histogram creation unit 11 creates only one histogram, without distinguishing the channels from one another. As another configuration, the configuration may be in such a way that a histogram is created, by utilizing the highest gray-scale level among the respective gray-scale levels, of the red, green, blue channels, for each pixel. Additionally, in the case where the type of the input video image is an input video image formed of the Y-channel, Cb-channel, and Cr-channel input video images consisting of a luminance signal and two color-difference signals, either the configuration may be in such a way that a histogram is created with regard to "Y" as the luminance channel, or the configuration may be in such a way that, after the input video image is converted into the red-channel, green-channel, and blue-channel video images in accordance with Formula 3, a histogram is created as described above.

$$\begin{bmatrix} R \\ G \\ B \end{bmatrix} = \begin{bmatrix} 1.0000 & 0.0000 & 1.4020 \\ 1.000 & -0.3441 & -0.7141 \\ 1.0000 & 1.7720 & 0.0000 \end{bmatrix} \begin{bmatrix} Y \\ Cb-128 \\ Cr-128 \end{bmatrix} \quad \text{[Formula 3]}$$

where "Y", "Cb", and "Cr" are the respective values, normalized to eight bits, of the luminance and color-difference signals, and "R", "G", and "B" are the respective values, normalized to eight bits, of the red-channel, the green-channel, and the blue-channel video signals. In addition, Formula 3 exemplifies the conversion; thus, other conversion coefficients may be utilized. Additionally, contrary to the foregoing conversion, a configuration is also possible in which the red-channel, green-channel, and blue-channel input video images are converted into Y-channel values in accordance with Formula 4, and then a histogram is created with the Y-channel values.

$$Y=0.299R+0.587G+0.114B \quad \text{[Formula 4]}$$

Figure 2:
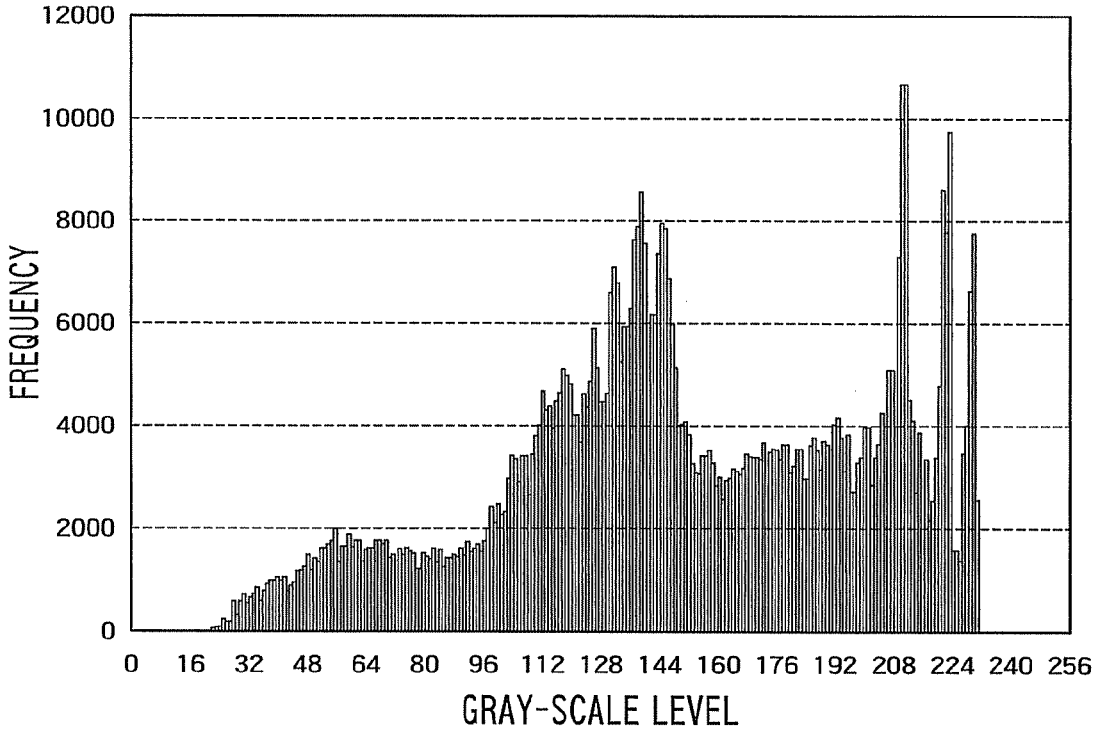
FIG. 2 is a graph representing an example of a histogram plotted along the abscissa in units of one gray-scale level.
Figure 3:
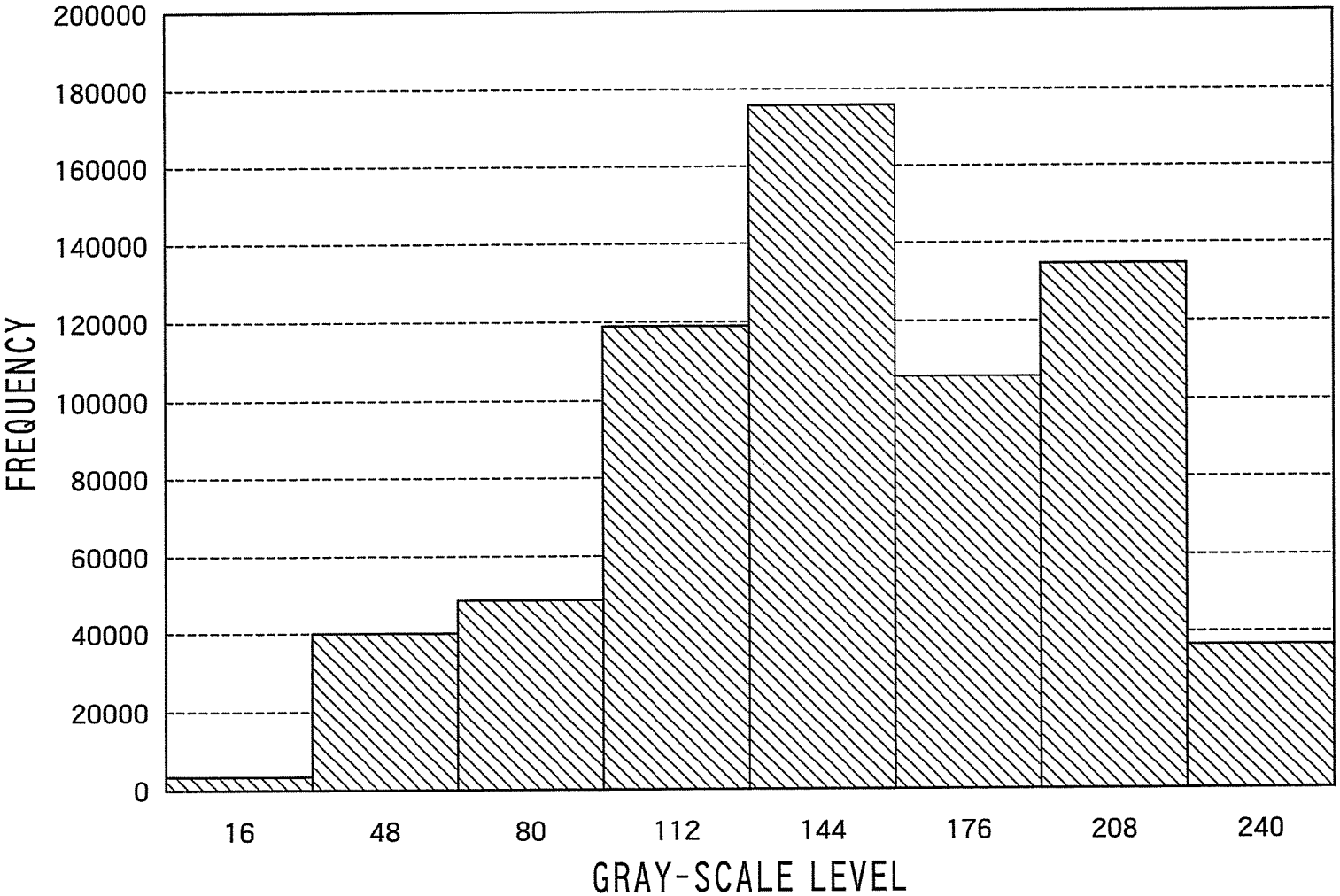
FIG. 3 is a graph representing an example of a histogram plotted along the abscissa in units of 32 gray-scale levels.

In the case where the red-channel, green-channel, and blue-channel input video images each have 8-bit gray-scale level, by counting the frequency of each gray-scale level and creating a histogram, a frequency distribution over the 0-th to 255-th gray-scale levels can be obtained, as represented in FIG. 2. In the example, the level-range is 1; the 0-th to 255-th gray-scale levels themselves represent the respective level-ranges. In this regard, however, in order to reduce the capacity of a memory that retains a histogram or to reduce the amount of processing in creating a histogram, the configuration for the creation of a histogram may be in such a way that a histogram on the basis of every two or more gray-scale levels is created, instead of the configuration in which, as represented in FIG. 2, the frequency for each gray-scale level is calculated. For example, FIG. 3 is an example of a histogram plotted along the abscissa in units of 32 gray-scale levels. In the case where the input video image has 8-bit gray-scale levels, by setting the five lower bits in a binary expression to zero, the input video image is rendered by the three upper bits; in other words, the overall gray-scale level is in units of 32 gray-scale level steps. Each level-range (e.g., from the 0-th to the 31-th gray-scale level) may be represented by the center value of that range. For example, with regard to the example in FIG. 3, the level-range from the 0-th to the 31-th gray-scale level is represented by the 16-th gray-scale level; and the level-range from the 32-th to the 63-th gray-scale level is represented by the 48-th gray-scale level. In addition, in order to further reduce the amount of calculation and memory capacity, the configuration may be in such a way that only some of gray-scale levels in a histogram are detected. For example, the configuration may be in such a way that, after a histogram for the overall gray-scale level is created, the respective gray-scale levels corresponding to the average value, the median value, and the modal value in the histogram are calculated, and the frequencies of the gray-scale levels other than the foregoing gray-scale levels (or at least one of the foregoing gray-scale levels) corresponding to the average value, the median value, and the modal value are made to be zero. The histogram created through the foregoing processing is inputted to the backlight-luminance calculator 12.

(Backlight-Luminance Calculator 12)

Figure 4:
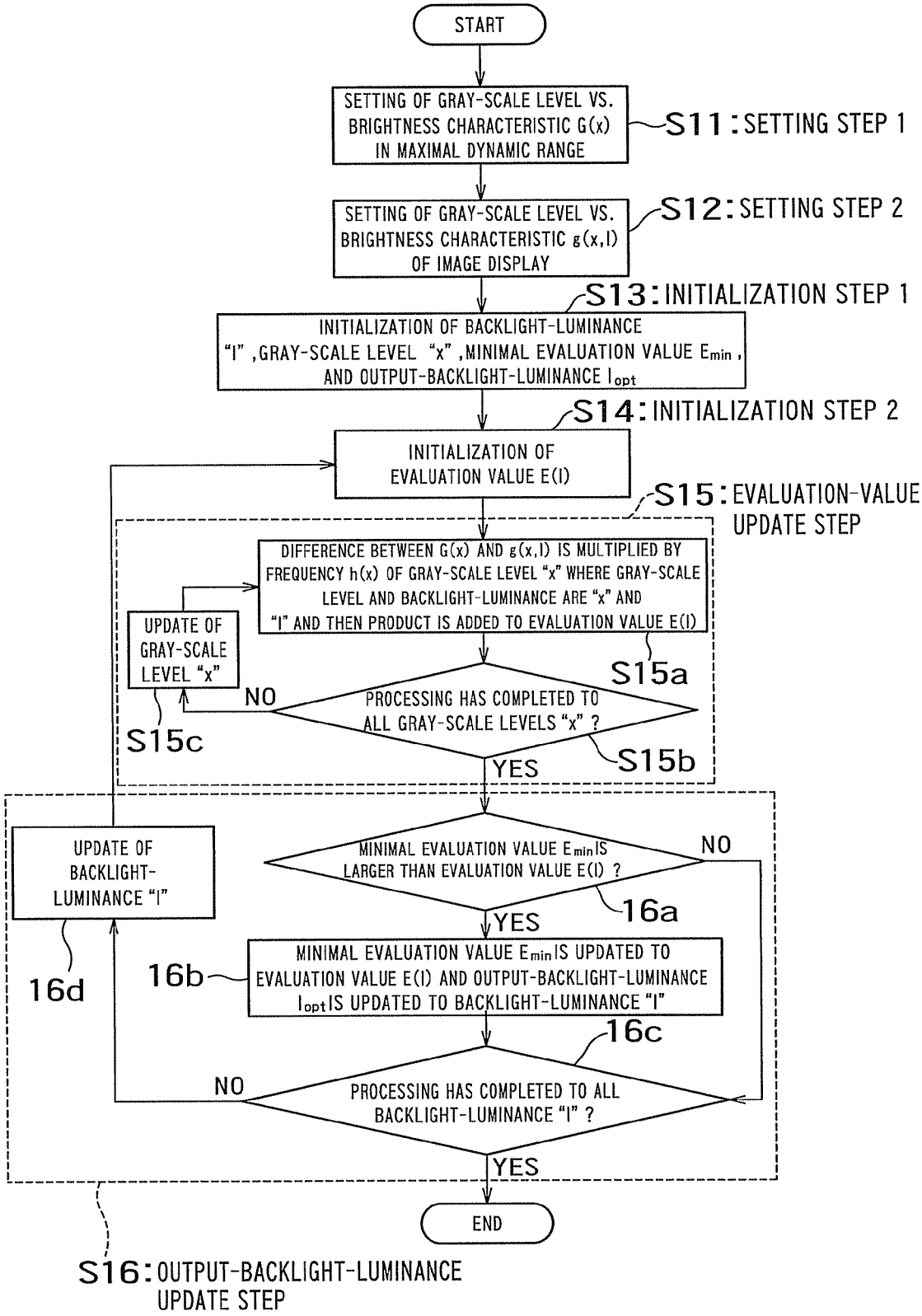
FIG. 4 is a flowchart for explaining the operation of a backlight-luminance calculator according to Embodiment 1.

The backlight-luminance calculator 12 calculates the backlight luminance, based on the histogram created by the histogram creation unit 11. The method of calculating the backlight luminance will be explained in detail below, with reference to the flowchart in FIG. 4.

In the setting step 1 (S11), the gray-scale level vs. brightness characteristic to be displayed on the image display 15 is set. In the backlight-luminance calculator 12, the maximal dynamic range of the image display 15 is preliminarily set. For example, in the case of an ideal maximal dynamic range where its maximal and minimal values are one and zero, respectively, the maximal dynamic range is represented as in Formula 5.

$$D_{min}=0$$

$$D_{max}=1 \quad \text{[Formula 5]}$$

where $D_{min}$ and $D_{max}$ are the minimal value and the maximal value, respectively, of the maximal dynamic range, displayed on the image display 15. In addition, the maximal dynamic range can be set as represented in Formula 6, based on a preliminarily set modulation range of the backlight-luminance and the characteristics of the liquid-crystal panel 16.

$$D_{min}=T_{min}I_{min}$$

$$D_{max}=T_{max}I_{max} \quad \text{[Formula 6]}$$

where $I_{min}$ and $I_{max}$ denote the minimal value and the maximal value, respectively, of the modulation range of the backlight-luminance and $T_{min}$ and $T_{max}$ denote the minimal transmittance and the maximal transmittance, respectively, of the liquid-crystal panel 16. In addition, $I_{min}$, $I_{max}$, $T_{min}$, and $T_{max}$ may be relative values; therefore, for example, $I_{min}$ may be set as a relative value in the case where $I_{max}$ is made to be one, and $T_{min}$ may be set as a relative value in the case where $T_{max}$ is made to be one. In addition, analytically, the maximal dynamic range is represented as in Formula 6; however, in practice, the configuration may be in such a way that, the measured luminance of the image display 15 in the case where the minimal gray-scale level (0-th gray-scale level, in the case of a liquid-crystal panel with which 8-bit rendering is possible) that can be displayed on the liquid-crystal panel 16 is displayed with the minimal backlight luminance in the modulation range of the luminance of the backlight 17 is defined as the minimal display luminance that can be displayed on the image display 15, the measured luminance of the image display 15 in the case where the maximal gray-scale level (255-th gray-scale level, in the case of a liquid-crystal panel with which 8-bit rendering is possible) that can be displayed on the liquid-crystal panel 16 is displayed with the maximal backlight luminance in the modulation range of the luminance of the backlight 17 is defined as the maximal display luminance that can be displayed on the image display 15, and then $D_{max}$ is set to one and the minimal display luminance in the case where the maximal display luminance is normalized to be one is set to $D_{min}$.

Next, the gray-scale level vs. brightness characteristic in the maximal dynamic range obtained as describes above is set. Assuming that brightness is represented by luminance, the gray-scale level vs. luminance characteristic can analytically be calculated as in Formula 7.

$$G(x) = \left(\frac{x}{255}\right)^{\gamma}(D_{\max} - D_{\min}) + D_{\min} \quad \text{[Formula 7]}$$

where "x" is the gray-scale level represented with eight bits, and "γ" is the gamma value utilized to correct an input video image. In general, as the gamma value, 2.2 is utilized. Formula 7 represents a gray-scale level vs. luminance characteristic; however, because the human brightness-sensitivity characteristic is in proportion to the logarithm of the luminance, the gray-scale level vs. brightness characteristic may be the gray-scale level vs. logarithmic luminance characteristic as represented in Formula 8.

$$G_{\log}(x) = \frac{\log(G(x))}{\log(G(255))} \quad \text{[Formula 8]}$$

In addition, as represented in Formula 9, lightness defined in uniform color space may be utilized as the gray-scale level vs. lightness characteristic.

$$G_{L*}(x)=G(x)^{1/3} \quad \text{[Formula 9]}$$

Strictly speaking, lightness, which is standardized by CIE (International Commission on Illumination), is supposed to vary in a nonlinear fashion in a dark region; however, in Formula 9, lightness is considered to be simple and proportional to brightness raised to the ⅓-th power.

$G(x)$, $G_{log}(x)$, $G_{L*}(x)$ described above each correspond to preliminarily set brightnesses for respective gray-scale levels.

Figures 5, 6:
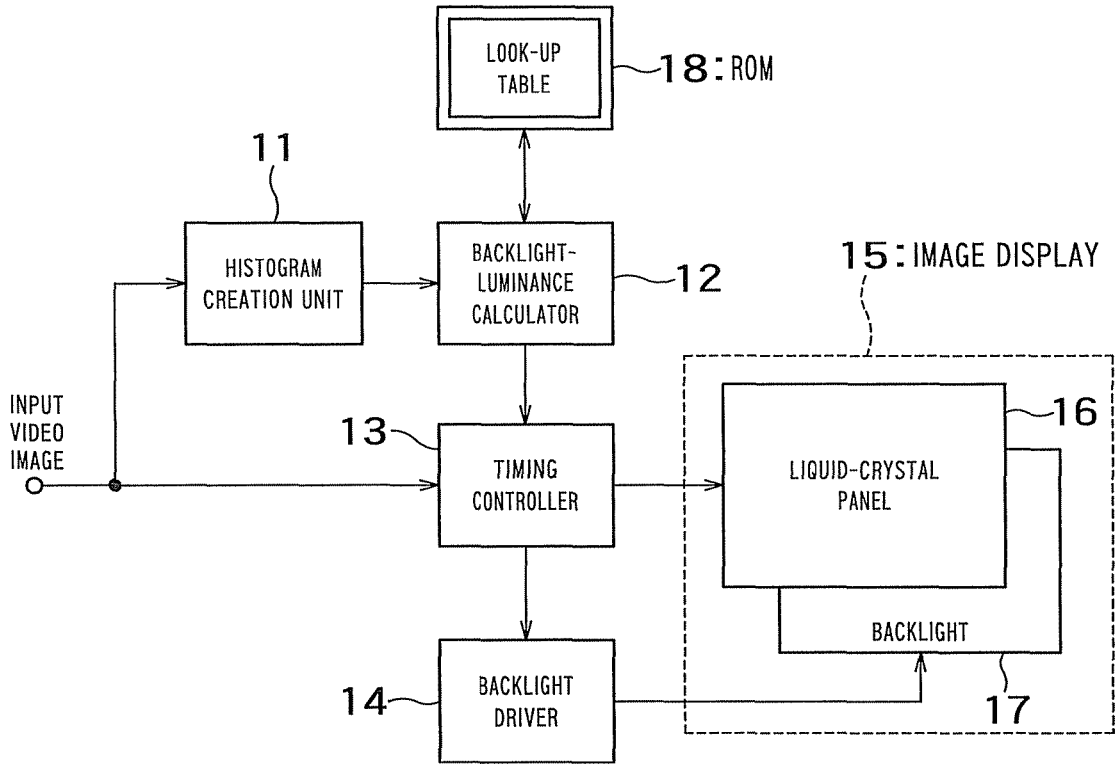
FIG. 5 is a table representing an example of table data in which the gray-scale level "x" and the brightness G(x) are related to each other.
FIG. 6 is a diagram obtained by adding a ROM to the image display apparatus in FIG. 1.

In addition, the gray-scale level vs. brightness characteristic may be calculated by utilizing Formulas 7 to 9; however, the configuration may be as described below. For example, after $D_{min}$ and $D_{max}$ are determined, lookup-table data, in which, based on the relationship between the gray-scale level "x" and the brightness G(x), the gray-scale level "x" and the brightness G(x) are related to each other, is preliminarily created. FIG. 5 is an example of the table data. Then, as illustrated in FIG. 6, the created table data is preliminarily stored in a ROM (Read Only Memory) 18 or the like that can be accessed by the backlight-luminance calculator 12. When the brightness at each gray-scale level is obtained, by, with regard to the gray-scale level "x", referring to the ROM 18, the brightness corresponding to the gray-scale level "x" is obtained. Additionally, in the case where a plurality of $D_{min}$s and a plurality of $D_{max}$s are prepared and the combination of $D_{min}$ and $D_{max}$ is changed, for example, by an instruction of a user, the configuration may be in such a way that a plurality of table data items corresponding to the respective combinations is prepared so as to refer to the table data corresponding to the set combination.

In the setting step 2 (S12), an actual gray-scale level vs. brightness characteristic of the image display 15 is set. The dynamic range, at a specific backlight-luminance "I", of the image display 15 is represented as in Formula 10.

$$d_{min}(I)=T_{min}I$$

$$d_{max}(I)=T_{max}I \quad \text{[Formula 10]}$$

where $d_{min}(I)$ and $d_{max}(I)$ are the minimal value and the maximal value, respectively, of the dynamic range, which can be displayed on the image display 15 in the case where the backlight-luminance is "I". In addition, analytically, the dynamic range of the image display 15 is represented as in Formula 10; however, in practice, the configuration of $d_{min}$ and $d_{max}$ may be in such a way that the measured luminance of the image display 15 in the case where the minimal gray-scale level (0-th gray-scale level, in the case of a liquid-crystal panel with which 8-bit rendering is possible) that can be displayed on the liquid-crystal panel 16 is displayed with the backlight-luminance "I" is defined as the minimal display luminance, which can be displayed on the image display 15, in the case where the backlight-luminance is "I", the measured luminance of the image display 15 in the case where the maximal gray-scale level (255-th gray-scale level, in the case of a liquid-crystal panel with which 8-bit rendering is possible) that can be displayed on the liquid-crystal panel 16 is displayed with the backlight-luminance "I" is defined as the maximal display luminance, which can be displayed on the image display 15, in the case where the backlight-luminance is $I_{max}$, and then the maximal display luminance in the case where $d_{max}(I_{max})$ is normalized to be one is set to $d_{max}(I)$ and the minimal display luminance in the case where $d_{max}(I_{max})$ is normalized to be one is set to $d_{min}(I)$.

In setting of the gray-scale level vs. brightness characteristic, of the image display 15, in the case where the backlight-luminance is "I" assuming that brightness is represented by luminance, the gray-scale level vs. luminance characteristic (in general, referred to as a gamma characteristic) of the image display 15 can analytically be represented as in Formula 11.

$$g(x, I) = \left(\frac{x}{255}\right)^{\Gamma}(d_{\max}(I) - d_{\min}(I)) + d_{\min}(I) \quad \text{[Formula 11]}$$

where "x" is the gray-scale level represented with eight bits, and "F" is the gamma value utilized to correct liquid-crystal panel 16. In general, as the gamma value, 2.2 is utilized. Formula 11 represents a gray-scale level vs. luminance characteristic; however, because the human brightness-sensitivity characteristic is in proportion to the logarithm of the luminance, the gray-scale level vs. brightness characteristic may be the gray-scale level vs. logarithmic luminance characteristic as represented in Formula 12.

$$g_{\log}(x, I) = \frac{\log(g(x, I))}{\log(g(255, I_{\max}))} \quad \text{[Formula 12]}$$

In addition, as represented in Formula 13, lightness defined in uniform color space may be utilized as the gray-scale level vs. lightness characteristic.

$$g_{L*}(x,I)=g(x,I)^{1/3} \quad \text{[Formula 13]}$$

In addition, as is the case with Formula 9, the lightness in Formula 13 is considered to be simple and proportional to brightness raised to the ⅓-th power.

$g(x,I)$, $g_{log}(x,I)$, $g_{L*}(x,I)$ described above each correspond to the brightness in the case the gray-scale level "x" is displayed on the image display, with the luminance "I" of the light source.

In addition, the gray-scale level vs. brightness characteristic may be calculated by utilizing Formulas 11 to 13; however, the configuration may be as described below. For example, after $d_{min}(I)$ and $d_{max}(I)$ are determined, lookup-table data, in which, based on the relationship between the gray-scale level "x" and the brightness g(x, I), the gray-scale level "x" and the brightness g(x, I) are related to each other, is preliminarily created. FIG. 7 is an example of the table data. The table data in FIG. 7 is retained as the correspondence of the gray-scale level to the brightness in the case the backlight-luminance varies every 0.1 from 0.1 to 1.0. Then, as illustrated in FIG. 6, the created table data is preliminarily stored in a ROM (Read Only Memory) 18 or the like that can be accessed by the backlight-luminance calculator 12. When the brightness at each gray-scale level is obtained, by, with regard to the gray-scale level "x" and the backlight-luminance "I", referring to the ROM 18, the brightness corresponding to the gray-scale level "x" in the case where the backlight-luminance is "I" is obtained. In addition, according to FIG. 7, the gray-scale level vs. brightness characteristic in the case where the backlight-luminance is "I" is retained; however, as another configuration, as represented in FIG. 8, the configuration may be in such a way that only the gray-scale level vs. brightness characteristic in the case where the backlight-luminance is "$I_{max}$ (=1.0)" is retained, and in the case of other backlight-luminances, the gray-scale level vs. brightness characteristics are calculated proportionately to the brightness in the case where the backlight-luminance is "$I_{max}$".

In addition, the setting steps 1 (S11) and 2 (S12) are not required to be performed for each frame of an input video image, but have to be performed only once at the beginning (e.g., when the power source for the image display apparatus is turned on). Additionally, in the case where the gray-scale level vs. brightness characteristic has already been retained as the table data, the setting steps 1 (S11) and 2 (S12) can be omitted.

In the initialization step 1 (S13), variables to be utilized in the processing below are initialized. For example, the processing as represented in Formula 14 is carried out.

$$I \leftarrow I_{min}$$

$$x \leftarrow 0$$

$$E_{min} \leftarrow MAX_VAL$$

$$I_{opt} \leftarrow I \qquad \text{[Formula 14]}$$

where $E_{min}$ denotes the minimal evaluation value to be utilized in the output-backlight-luminance update step (S16) described later, and $I_{opt}$ denotes the output-backlight-luminance that is finally determined. The symbol "←" denotes that the value in the right side is substituted for the value in the left side. "MAX_VAL" is the maximal value that the evaluation value E(I) described later can reach.

In the initialization step 2 (S14), the evaluation value E(I) to be utilized in the evaluation-value update step (S15) described later is initialized as represented in Formula 15.

$$E(I) \leftarrow 0 \qquad \text{[Formula 15]}$$

In the evaluation-value update step (S15), in the first place, the difference between the brightness G(x) in the maximal dynamic range and the brightness g(x, I) of the image display 15 in the case where the current gray-scale level and the backlight-luminance are "x" and "I", respectively, is calculated, the difference value is multiplied by the frequency h(x), of the gray-scale level "x", obtained in the histogram creation unit 11, and then the product is added to the evaluation value E(I) (S15*a*). For example, in the case where the difference is evaluated on the basis of an absolute value, the evaluation value E(I) is represented as in Formula 16. The processing of calculating the difference corresponds to the processing by a difference calculation unit; the processing of performing the multiplication corresponds to the processing by a difference accumulating unit.

$$E(I) \leftarrow E(I) + |G(x) - g(x,I)|h(x) \qquad \text{[Formula 16]}$$

In the case where the difference is evaluated on the basis of a squared error, the evaluation value E(I) is represented as in Formula 17.

$$E(I) \leftarrow E(I) + \{G(x) - g(x,I)\}^2 h(x) \qquad \text{[Formula 17]}$$

In addition, in each of Formulas 16 and 17, the evaluation is performed by use of a gray-scale level vs. brightness characteristic; however, as that gray-scale level vs. brightness characteristic, the gray-scale level vs. brightness characteristic that has been set in the setting steps 1 (S11) and 2 (S12) may be utilized. When the gray-scale level vs. lightness characteristic is utilized as the gray-scale level vs. brightness characteristic, the evaluation in the case where a squared error is utilized as the difference is represented as in Formula 18.

$$E(I) \leftarrow E(I) + \{G_{L^*}(x) - g_{L^*}(x,I)\}^2 h(x) \qquad \text{[Formula 18]}$$

In addition, the appropriate variants $h_n(x)$ and $h_\alpha(x)$, created in the histogram creation unit, of the frequency h(x) of the gray-scale level "x" can be utilized. Moreover, the configuration may be in such a way that, in the evaluation-value update step, a weight is added to the h(x) obtained in the histogram creation unit. For example, in the case where the update of the evaluation value is performed in accordance with Formula 16, the evaluation value is represented as follows:

$$E(I) \leftarrow E(I) + |G(x) - g(x,I)|h(x)^\alpha \qquad \text{[Formula 19]}$$

where "α" is a weight expressed by the power to which the frequency h(x) of the gray-scale level "x" is raised; "α" can take various values; however, it is made to be between zero and one, on an empirical basis.

After the evaluation-value update for the current gray-scale level "x" is completed, it is determined whether or not the evaluation-value updates for all the gray-scale levels "x" have been completed (S15*b*); in the case where the evaluation-value updates for all the gray-scale levels "x" have been completed (YES), the step S15*b* is followed by the output-backlight-luminance update step (S16); In contrast, in the case where that the evaluation-value updates for all the gray-scale levels "x" have not been completed (NO), the gray-scale level "x" is updated (S15*c*), and the evaluation value is updated again (S15*a*). For example, in the case where, in a histogram obtained in the histogram creation unit 11, the frequency has been obtained for each gray-scale level from the 0-th gray-scale level to the 255-th gray-scale level, it is determined whether or not the gray-scale level "x" is the 255-th gray-scale level or higher; when the gray-scale level "x" is lower than the 255-th gray-scale level, one is added to the gray-scale level "x" so as to update the gray-scale level "x".

In addition, in the foregoing setting steps 1 (S11) and 2 (S12), a configuration in which the gray-scale level vs. brightness characteristics G(x) and g(x, I) are retained as table data has been explained; moreover, the configuration may be in such a way that the difference between the gray-scale level vs. brightness characteristics G(x) and g(x, I) is retained as the table data. In other words, in the case where the evaluation value E(I) is evaluated in accordance with Formula 16, table data in which, as FIG. 9 represents an example, the gray-scale level "x" and the absolute value of the difference between G(x) and g(x, I) are related to each other for each modulated backlight-luminance is preliminarily retained in the ROM 18 as illustrated in FIG. 6 or the like, and, when the evaluation is performed in accordance with Formula 16, the table data is referred to with regard to the gray-scale level "x" and the backlight-luminance "I" so as to obtain the difference value.

In the output-backlight-luminance update step (S16), it is determined whether or not the evaluation value E(I), at the backlight-luminance "I", obtained in the evaluation-value update step (S15) is smaller than the minimal evaluation value $E_{min}$ (S16*a*); when the evaluation value E(I) is smaller than the minimal evaluation value $E_{min}$ (YES), the output-backlight-luminance $I_{opt}$ is updated to the current backlight-luminance "I", and the minimal evaluation value $E_{min}$ is updated to the current evaluation value E(I) (S16*b*). In the last place, it is determined whether or not the evaluation has been performed for all the preliminarily set backlight-luminances (the first to the n-th luminance) (S16*c*); when the evaluation for all the preliminarily set backlight-luminance has not been performed (NO), the backlight-luminance "I" is updated (S16*d*), and the initialization step 2 (S14) is resumed. For example, in the case where, in the modulation range of the backlight-luminance, the luminance increases from $I_{min}$ to $I_{max}$, in steps of 0.1 and the current backlight-luminance "I" is smaller than $I_{max}$, 0.1 is added to the backlight-luminance "I" so as to update the backlight-luminance "I". In contrast, in the case where the evaluation for all the preliminarily set luminances of the backlight light source has been performed (YES), the current output-backlight-luminance $I_{opt}$ is outputted from the backlight-luminance calculator 12. That is to say, the backlight-luminance calculator 12 selects the backlight-luminance, among a plurality of backlight-luminances, which can bring about the minimal evaluation value, and then outputs, as the output-backlight-luminance $I_{opt}$, the selected backlight-luminance. The processing corresponds, for example, to the processing by a selection unit. In the present embodiment, an example, in which the backlight-luminance, among a plurality of predetermined backlight-luminances, which can bring about the minimal evaluation value is selected, has been explained; however, instead of the above, the configuration may be in such a way that the processing is ended at the moment when an evaluation value that is the same as or smaller than a predetermined threshold value is obtained, and the backlight-luminance at that moment is selected. With that configuration, it is not necessarily required to implement the calculation for obtaining the evaluation values for all the backlight-luminances; therefore, the processing time of the backlight-luminance calculator 12 can be reduced.

In the present embodiment, the evaluation value E(I) suggests the degree of similarity between the histogram, for an input video image, based on the gray-scale level vs. brightness characteristic with which the input video image is preferably displayed on the image display 15 and the histogram, for the input video image, based on the gray-scale level vs. brightness characteristic of the image display 15 in the case where the current backlight-luminance is "I".

In other words, it is suggested that the smaller is the evaluation value E(I), the more similar to the histogram for an input video image which is desired to be displayed on the image display 15 is the histogram for the input video image actually displayed on the image display 15 in the case where the current backlight-luminance is "I". Accordingly, the evaluation values E(I) for a plurality of backlight-luminances "I" are obtained, and the backlight-luminance "I" that brings about the minimal E(I) is set as the output-backlight-luminance $I_{opt}$.

(Timing Controller 13)

The timing controller 13 controls the timing between a video signal to be transmitted to the liquid-crystal panel 16 and a backlight-luminance signal to be transmitted to the backlight driver 14. The histogram creation unit 11, as its basic operation, scans all the pixels in one frame of an input video image so as to create a histogram; therefore, the moment when a video image is inputted to the timing controller 13 and the moment when the backlight-luminance signal for that video image is inputted from the backlight-luminance calculator 12 to the timing controller 13 differ from each other by one frame period or more. Accordingly, in order to adjust the delay in the timing, the timing controller 13 delays the moment when the input video image is outputted, e.g., by use of a frame buffer so that the moment when the input video image is outputted is synchronized with the moment when the backlight-luminance signal is outputted. Alternatively, because, in general, an input video image temporally continues, the configuration may be in such a way that, for example, the luminance I(n), of the backlight light source, obtained based on the n-th frame of an input video image is synchronized with the (n+1)-th frame of the input video signal. In other words, the backlight-luminance is delayed by one frame period from the video image actually displayed on the image display 15. In this case, it is not required to largely delay the input video image by the timing controller 13; therefore, memory capacity can be reduced. In addition, in the timing controller 13, various synchronization signals (such as a horizontal synchronous signal and a vertical synchronous signal), which are necessary to drive the liquid-crystal panel 16, are created and transmitted to the liquid-crystal panel 16, along with the input video signal.

(Backlight Driver 14)

Based on the backlight-luminance signal outputted from the timing controller 13, the backlight driver 14 creates a drive signal for making the backlight 17 actually emit light. The configuration of the backlight drive signal differs depending on the type of the light source provided in the backlight 17; in general, as the backlight light source for a liquid-crystal display device, a cold-cathode tube, a light emitting diode (LED), or the like is utilized. The luminances of the foregoing light sources can be modulated by controlling the voltage or the current to be applied. In general, however, the PWM (Pulse Width Modulation) control, in which the luminance is modulated by rapidly switching the emission period and the non-emission period, is utilized. In the present embodiment, the configuration is in such a way that, as the backlight light source, an LED light source the emission intensity of which can relatively easily be controlled is utilized and luminance-modulated through the PWM control. Thus, based on the backlight-luminance signal, the backlight driver 14 creates a PWM control signal, which is transmitted to the backlight 17.

(Image Display 15)

As described above, the image display 15 is configured with the liquid-crystal panel 16 as a light modulation device and the backlight 17, disposed behind the liquid-crystal panel 16, in which the luminance of the light source can be modulated. In the image display 15, the video signal outputted from the timing controller 13 is written in the liquid-crystal panel 16 (light modulation device) and the backlight drive signal outputted from the backlight driver 14 makes the backlight 17 emit light, so that the input video image is displayed. In addition, as described above, in the present embodiment, an LED light source is utilized as the backlight light source.

As described heretofore, according to the present embodiment, the luminance of a light source is controlled in consideration of the distribution of the gray-scale levels in an input video image; therefore, the luminance of a light source can be controlled more accurately, whereby an image display apparatus which is excellent in visual contrast and whose power consumption is reduced can be provided.

Embodiment 2

An image display apparatus, according to Embodiment 2 of the present invention, whose basic configuration is the same as that of Embodiment 1 has features in that, in a backlight-luminance calculator, a predetermined gray-scale level-conversion is performed and then evaluation values are calculated and in that an input video image receives a predetermined gray-scale level-conversion and then is transmitted to a liquid-crystal panel.

Figure 10:
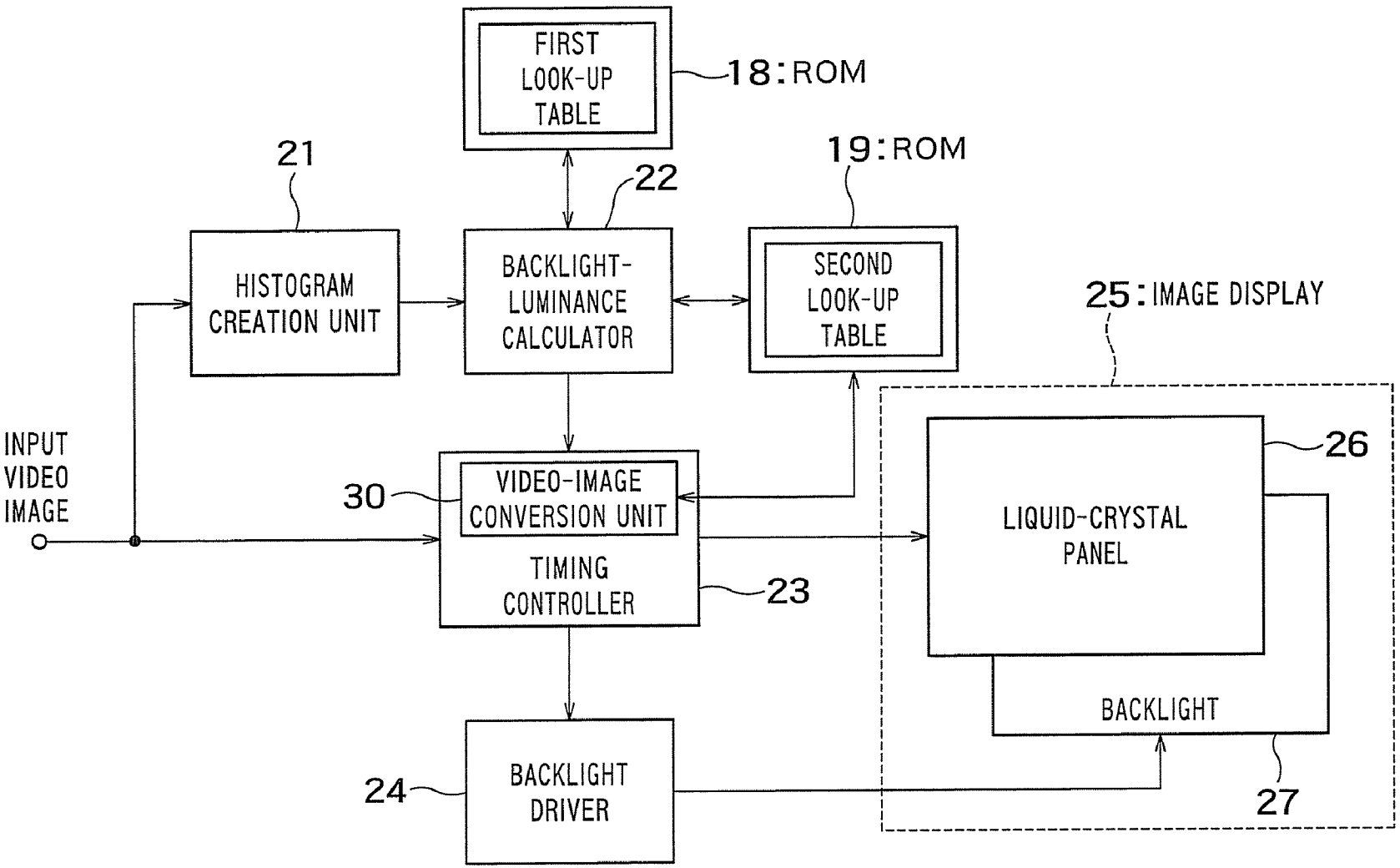
FIG. 10 is a diagram illustrating the configuration of an image display apparatus according to Embodiment 2.

FIG. 10 is a diagram illustrating the configuration of an image display apparatus according to Embodiment 2 of the present invention. As is the case with Embodiment 1, the configuration in which the gray-scale level vs. brightness characteristic is obtained with reference to table data (a first look-up table in the ROM 18) (refer to FIGS. 5 and 7) is utilized. As is the case with Embodiment 1, an input video image is inputted to a histogram creation unit 21 and a timing controller 23, and a histogram is created in the histogram creation unit 21. With reference to a first look-up table, in the ROM 18, in which a gray-scale level vs. brightness characteristic is retained and a second look-up table, in a ROM 19, in which a predetermined gray-scale-level-conversion-rule is retained, the backlight-luminance calculator 22 calculates the backlight-luminance and transmits the calculated backlight-luminance to the timing controller 23. The timing controller 23, which is, in contrast to Embodiment 1, further provided with a video-image conversion unit 30, adjusts the synchronization between the input video image and the luminance of the backlight, calculated by the backlight-luminance calculator 22, and in the video-image conversion unit 30, applies a gray-scale level-conversion to the input video image, with reference to the second look-up table. The input video image that has received the gray-scale level-conversion in the video-image conversion unit 30 is transmitted, along with a synchronization signal for driving a liquid-crystal panel 26, to the liquid-crystal panel 26; the luminance of the backlight is transmitted to a backlight driver 24. Based on the inputted backlight luminance, the backlight driver 24 creates a backlight drive signal, for actually driving and controlling a backlight, which is transmitted to a backlight 27. In the last place, the input video image that has received the gray-scale level-conversion is written in the liquid-crystal panel 26; at the same time, based on the backlight drive signal outputted from the backlight driver 24, the backlight emits light, so that an image is displayed on the liquid-crystal panel 26.

The backlight-luminance calculator 22, which makes the configuration of the present embodiment different from that of Embodiment 1, and the timing controller 23 will be explained in detail below. In addition, other configurations are the same as those in Embodiment 1; therefore, explanations for them will be omitted.

(Backlight-Luminance Calculator 22)

Figure 11:
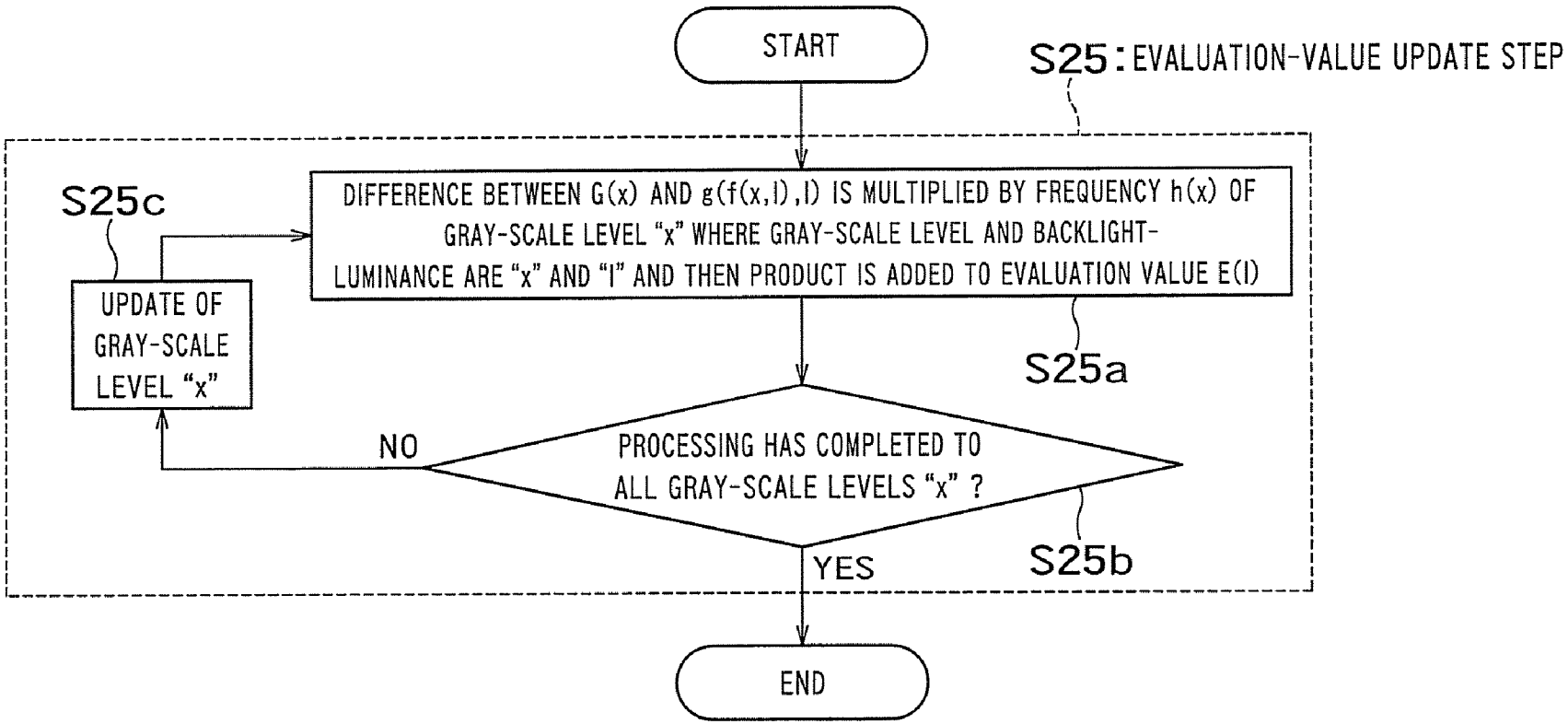
FIG. 11 is a flowchart for explaining the evaluation-value update step in Embodiment 2.

The processing in the backlight-luminance calculator 22, which is the same as that in Embodiment 1 in terms of the basic flow, has a feature in that, in the evaluation-value update step, a predetermined gray-scale level-conversion is performed and then evaluation values are calculated. The configurations other than the evaluation-value update step are the same as those in Embodiment 1; therefore, in embodiment 2, the evaluation-value update step will be explained with reference to a flowchart illustrated in FIG. 11.

In the evaluation-value update step in Embodiment 1, the configuration is in such a way that the difference between the brightness G(x) in the maximal dynamic range and the brightness g(x, I) of the image display in the case where the current gray-scale level and the backlight-luminance are "x" and "I", respectively is calculated, the difference value is multiplied by the frequency h(x), of the gray-scale level "x", obtained in the histogram creation unit, and then the product is added to the evaluation value E(I). In contrast, in the evaluation-value update step (S25) in Embodiment 2, after applying a predetermined a gray-scale level-conversion f(x) to the gray-scale level "x", the difference between the brightness G(x) in the maximal dynamic range and the brightness g(f(x), I) of an image display 25 in the case where the current gray-scale level and the backlight-luminance are "x" and "I", respectively is calculated, the difference value is multiplied by the frequency h(x), of the gray-scale level "x", obtained in the histogram creation unit 21, and then the product is added to the evaluation value E(I) (S25*a*). In the case where a gray-scale level-conversion is represented by f(x), the gray-scale level-conversion depends only on the gray-scale level "x"; therefore, the gray-scale level-conversion is a constant gray-scale level-conversion, regardless of the backlight-luminance or the like. However, in the present embodiment, in order to further improve the visual contrast, the configuration is in such a way that the gray-scale level-conversion f(x, I) that varies depending on the luminance "I" of the backlight light source is performed. For example, in the case where the difference is evaluated on the basis of an absolute value, the evaluation value E(I) is represented as in Formula 20.

$$E(I) \leftarrow E(I) + |G(x) - g(f(x,I),I)|h(x) \quad \text{[Formula 20]}$$

In the case where the difference is evaluated on the basis of a squared error, the evaluation value E(I) is represented as in Formula 21.

$$E(I) \leftarrow E(I) + \{G(x) - g(f(x,I),I)\}^2 h(x) \quad \text{[Formula 21]}$$

In addition, in Formulas 20 and 21, the evaluation is performed by use of the gray-scale level vs. brightness characteristic; however, as that gray-scale level vs. brightness characteristic, the gray-scale level vs. brightness characteristic that has been set in the setting steps 1 and 2 may be utilized. When the gray-scale level vs. lightness characteristic is utilized as the gray-scale level vs. brightness characteristic, the evaluation in the case where a squared error is utilized as the difference is represented as in Formula 22.

$$E(I) \leftarrow E(I) + \{G_{L^*}(x) - g_{L^*}(f(x,I),I)\}^2 h(x) \quad \text{[Formula 22]}$$

After the evaluation-value update for the current gray-scale level "x" is completed, it is determined whether or not the evaluation-value updates for all the gray-scale levels "x" have been completed (S25*b*); in the case where the evaluation-value updates for all the gray-scale levels "x" have not been completed (NO), the gray-scale level "x" is updated (S25*c*), and the evaluation value is updated again (S25*a*). For example, in the case where, in a histogram obtained in the histogram creation unit 21, the frequency has been obtained for each gray-scale level from the 0-th gray-scale level to the 255-th gray-scale level, firstly, it is determined whether or not the gray-scale level "x" is the 255-th gray-scale level or higher; when the gray-scale level "x" is lower than the 255-th gray-scale level, one is added to the gray-scale level "x" so as to update the gray-scale level "x".

Figure 12:
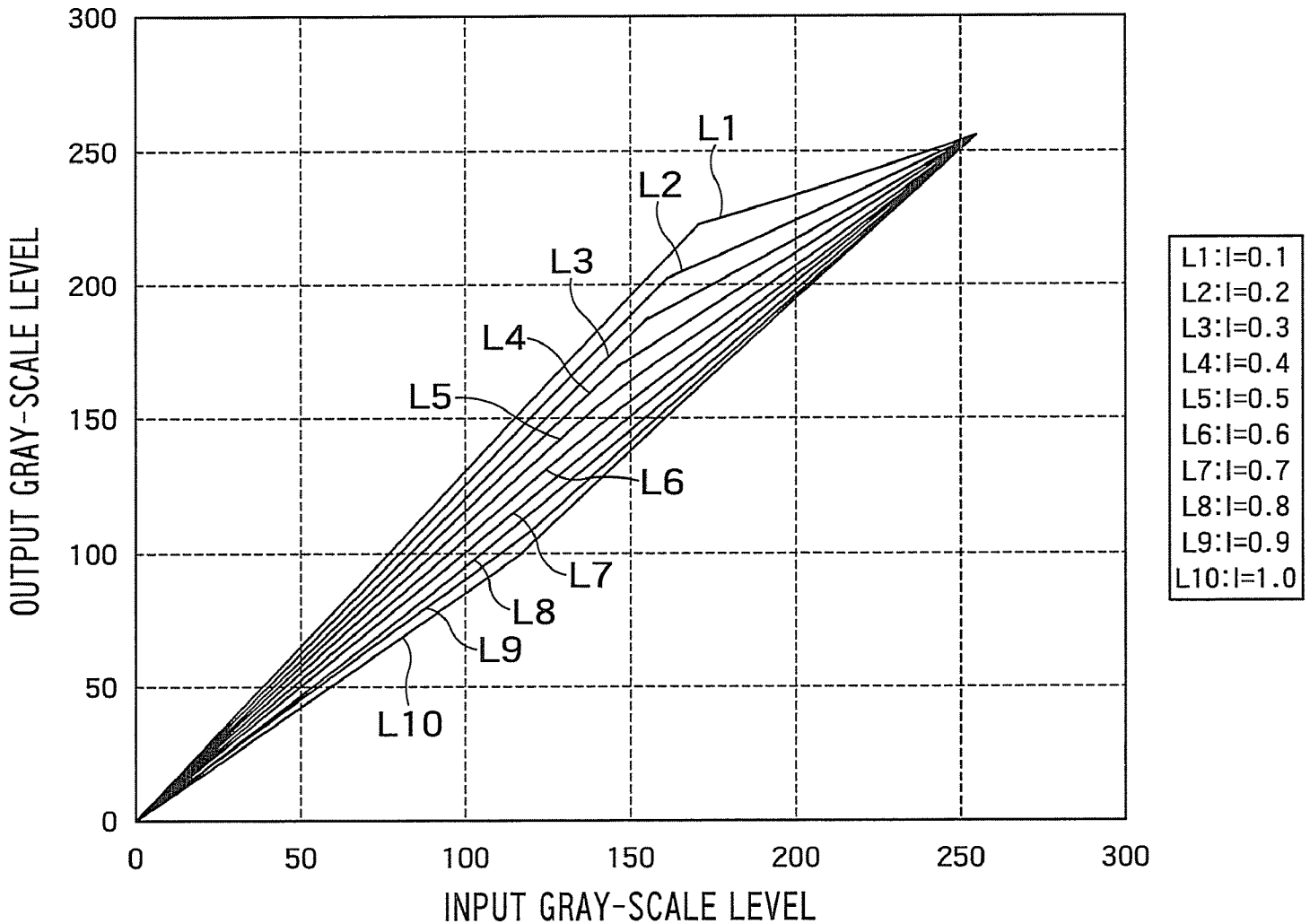
FIG. 12 is a graph representing the relationship between the input gray-scale level "x" and the output gray-scale level f(x, I)

The gray-scale level-conversion f(x, I) may be configured in various manners; however, in the present embodiment, the relationship, as represented in FIG. 12, between the input gray-scale level "x" and the output gray-scale level f(x, I) is utilized. In other words, when the backlight-luminance is small, the gradient of the output gray-scale level to the input gray-scale level at the lower gray-scale level side is made large, and, when the backlight-luminance is large, the gradient of the output gray-scale level to the input gray-scale level at the higher gray-scale level side is made large. In the case where the luminance "I" of the backlight light source is small, a great number of gray-scale levels in an input video image exist at the lower gray-scale level side; thus, by making large the gradient of the output gray-scale level to the input gray-scale level at the lower gray-scale level side, the contrast in the dark portion can further be enhanced. In contrast, in the case where the luminance "I" of the backlight light source is large, a great number of gray-scale levels in the input video image exist at the higher gray-scale level side; thus, by making large the gradient of the output gray-scale level to the input gray-scale level at the higher gray-scale level side, the contrast in the bright portion can further be enhanced. In addition, in FIG. 12, the gray-scale level-conversion is configured with two lines whose gradients are different from each other; however, the gray-scale level-conversion may be configured, e.g., with a smooth curve. The gray-scale level-conversion f(x, I) can be obtained through calculation in the backlight-luminance calculator 22; however, in the present embodiment, the configuration is in such a way that table data, in which the input gray-scale level "x" and the output gray-scale level f(x, I) are related to each other, is retained, as the second look-up table, in the ROM 19. FIG. 13 is an example of the second look-up table. In the evaluation-value update step, by, with regard to the current gray-scale level "x" and the luminance "I" of the backlight light source, referring to the second look-up table, the output gray-scale level f(x, I) is obtained. Next, as is the case with Embodiment 1, by, with regard to the output gray-scale level f(x, I) and the luminance "I" of the backlight light source, referring to the look-up table, the corresponding brightness is obtained.

(Timing Controller 23)

The basic operation of the timing controller 23 is the same as that in the case of Embodiment 1; however, the timing controller 23 in the present embodiment, which is further provided with a video-image conversion unit 30, is configured in such a way as to apply a gray-scale level-conversion to an input video image and then transmit the converted input video image to the liquid-crystal panel 26. The operation of the timing controller 23 is the same as that in the case of Embodiment 1, except for the video-image conversion unit 30; therefore, in the present embodiment, the operation of the video-image conversion unit 30 will be explained in detail.

The video-image conversion unit 30 applies the gray-scale level-conversion to each of the gray-scale levels of the pixels in an input video image, by, utilizing that gray-scale level and the luminance $I_{opt}$ of the backlight light source, calculated in the backlight-luminance calculator 22, referring to the second look-up table. In other words, the processing in accordance with Formula 23 is applied to the gray-scale level L(u, v), in the input video image, at the horizontal pixel position "u" and the vertical pixel position "v".

$$L_{out}(u,v)=f(L(u,v),I_{opt}) \quad \text{[Formula 23]}$$

where $L_{out}(u, v)$ is the converted gray-scale level of the pixel, in the input video image, at the position (u, v). By applying the processing in accordance with Formula 23 to all the pixels in one frame of the input video image, the input video image is converted, and while being synchronized with the backlight-luminance signal, the converted input video image is transmitted to the liquid-crystal panel 26.

As described heretofore, according to the present embodiment, an image display apparatus which is excellent in visual contrast and whose power consumption is reduced can be provided.

Embodiment 3

An image display apparatus, according to Embodiment 3 of the present invention, whose basic configuration is the same as that in the case of Embodiment 2 has features in that, after, with regard to the gray-scale level-conversion in the backlight-luminance calculator, the gray-scale level-conversion based on the minimal gray-scale level whose frequency in the histogram obtained from an input video image is not zero and the maximal gray-scale level whose frequency in the histogram is not zero is performed, evaluation values are calculated, and in that the input video image is converted by utilizing the same gray-scale level-conversion and then is transmitted to the liquid-crystal panel.

Figure 14:
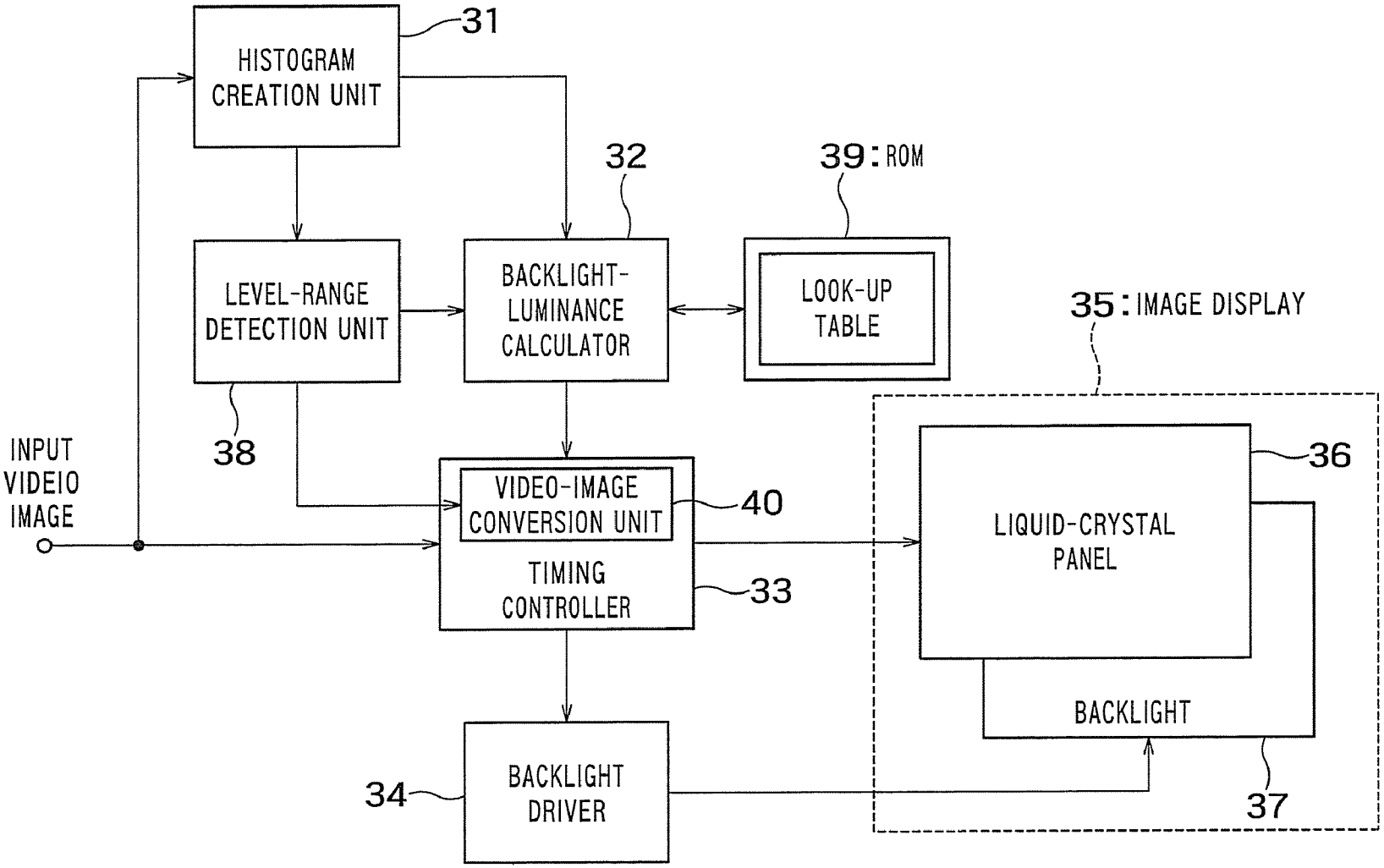
FIG. 14 is a diagram illustrating the configuration of an image display apparatus according to Embodiment 3.

FIG. 14 is a diagram illustrating the configuration of an image display apparatus according to Embodiment 3 of the present invention. As is the case with Embodiment 2, an input video image is inputted to a histogram creation unit 31 and a timing controller 33, and a histogram is created in the histogram creation unit 31. The created histogram is transmitted to a backlight-luminance calculator 32 and a level-range detection unit 38. The level-range detection unit 38 detects in the histogram the minimal and maximal gray-scale levels whose frequencies are not zero. Based on a gray-scale level-conversion that is determined on the basis of the minimal gray-scale level and the maximal gray-scale level that have been detected by the level-range detection unit 38, a backlight-luminance calculator 32 calculates the backlight-luminance with reference to a look-up table, in a ROM 39, in which a gray-scale level vs. brightness characteristic is retained, and transmits the calculated backlight-luminance to the timing controller 33. The timing controller 33, which is, as is the case with Embodiment 2, provided with a video-image conversion unit 40, adjusts the synchronization between the input video image and the luminance of the backlight, calculated by the backlight-luminance calculator 32, and in the video-image conversion unit 40, applies to the input video image the gray-scale level-conversion based on the minimal and maximal gray-scale levels detected in the level-range detection unit 38. The input video image converted by the gray-scale level-conversion in the video-image conversion unit 40 is transmitted, along with a synchronization signal for driving a liquid-crystal panel 36, to the liquid-crystal panel 36; the luminance of the backlight is transmitted to a backlight driver 34. Based on the inputted backlight luminance, the backlight driver 34 creates a backlight drive signal, for actually driving and controlling a backlight, which is transmitted to a backlight 37. In the last place, the input video image converted by the gray-scale level-conversion is written in the liquid-crystal panel 36; at the same time, based on the backlight drive signal outputted from the backlight driver 34, the backlight 37 emits light, so that an image is displayed on the liquid-crystal panel 36.

The level-range detection unit 38, which makes the configuration of the present embodiment different from that of Embodiment 2, the backlight-luminance calculator 32, and the video-image conversion unit 40 will be explained in detail below. In addition, other configurations are the same as those in Embodiment 2; therefore, explanations for them will be omitted.

(Level-Range Detection Unit 38)

The level-range detection unit 38 detects the minimal and maximal gray-scale levels whose frequencies are not zero, with reference to the histogram detected by the histogram creation unit 31. In other words, the minimal and maximal gray-scale levels included in the input video image are detected. The detection method can be devised in various manners; however, in the present embodiment, the configuration is in such a way that the first gray-scale level, in the scanning that is started from the 0-th gray-scale level, whose frequency is not zero is defined as the minimal gray-scale level and the first gray-scale level, in the scanning that is started from the 255-th gray-scale level, whose frequency is not zero is defined as the maximal gray-scale level. In addition, as described above, the minimal and maximal gray-scale levels are not required to be strictly obtained; for example, the configuration may be in such a way that the respective gray-scale levels whose frequencies exceed a frequency corresponding to a predetermined proportion (e.g., 5%) in the whole frequency are defined as the minimal and maximal gray-scale levels. That is to say, the configuration may be in such a way that the gray-scale level, in the scanning that is started from the 0-th gray-scale level, whose accumulated frequency exceeds 5% of the whole frequency is defined as the minimal gray-scale level and the gray-scale level, in the scanning that is started from the 255-th gray-scale level, whose accumulated frequency exceeds 5% of the whole frequency is defined as the maximal gray-scale level. The foregoing configuration can reduce, for example, the effect of noise included in an input video image.

(Backlight-Luminance Calculator 32)

The processing in the backlight-luminance calculator 32 is the same as that in Embodiment 2 in terms of the basic flow; however, the method for the gray-scale level-conversion performed in the evaluation-value update step is configured in a manner different from the method in Embodiment 2. The configurations other than the gray-scale level-conversion are the same as those in Embodiment 2; therefore, in the present embodiment, the gray-scale-level-conversion-rule will be explained.

The gray-scale-level-conversion-rule according to the present embodiment prescribes that the gray-scale level-conversion is performed based on the minimal gray-scale level $L_{min}$ and the maximal gray-scale level $L_{max}$ that have been detected by the level-range detection unit 38. More specifically, the minimal gray-scale level $L_{min}$ and the maximal gray-scale level $L_{max}$ are expanded to the minimal gray-scale level (the 0-th gray-scale level) and to the maximal gray-scale level (the 255-th gray-scale level in the case of eight bits), respectively, which can be rendered by the liquid-crystal panel 36. Accordingly, the gray-scale level-conversion f(x, $L_{min}$, $L_{max}$) is represented as in Formula 24.

$$f(x, L_{\min}, L_{\max}) = \frac{255}{L_{\max} - L_{\min}}(x - L_{\min}) \quad \text{[Formula 24]}$$

Figure 15:
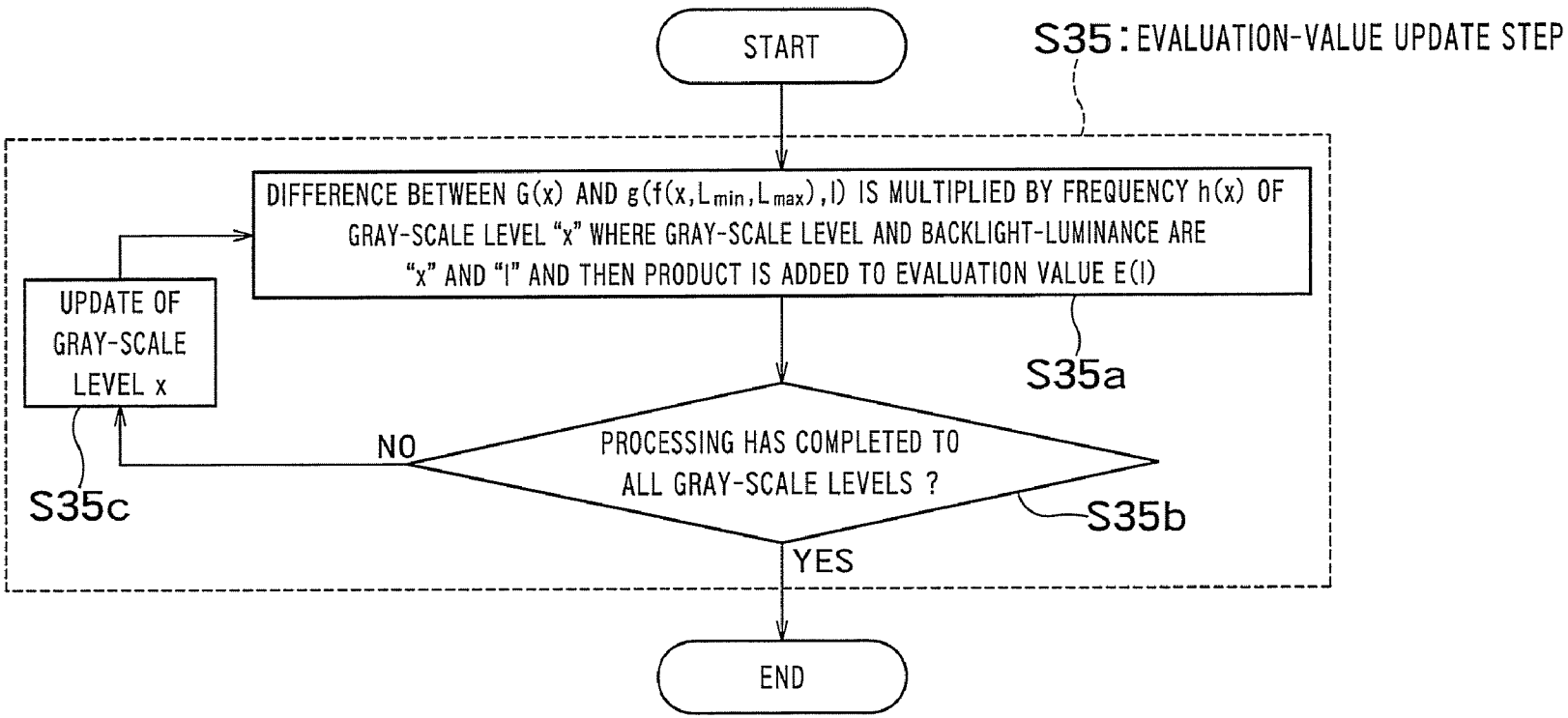
FIG. 15 is a flowchart for explaining an evaluation-value update step in Embodiment 3.

FIG. 15 is a flowchart illustrating an evaluation-value update step according to the present embodiment. In the evaluation-value update step (S35), the evaluation value is calculated through the gray-scale level-conversion f(x, $L_{min}$, $L_{max}$) represented in Formula 24 (S35*a*). After the evaluation-value update for the current gray-scale level "x" is completed, it is determined whether or not the evaluation-value updates for all the gray-scale levels "x" have been completed (S35*b*); in the case where that the evaluation-value updates for all the gray-scale levels "x" have not been completed (NO), the gray-scale level "x" is updated (S35*c*), and the evaluation value is updated again (S35*a*).

(Video-Image Conversion Unit 40)

The video-image conversion unit 40 applies the gray-scale level-conversion to each of the gray-scale levels of the pixels in the input video image, with reference to that gray-scale level and the minimal and maximal gray-scale levels detected in the level-range detection unit 38. In other words, the processing in accordance with Formula 25 is applied to the gray-scale level L(u, v), in the input video image, at the horizontal pixel position "u" and the vertical pixel position "v"

$$L_{out}(u,v)=f(L(u,v),L_{min},L_{max}) \quad \text{[Formula 25]}$$

where $L_{out}$(u, v) is the converted gray-scale level of the pixel, in the input video image, at the position (u, v). By applying the processing in accordance with Formula 25 to all the pixels in one frame of the input video image, the input video image is converted.

As described heretofore, according to the present embodiment, an image display apparatus which is excellent in visual contrast and whose power consumption is reduced can be provided.

Embodiment 4

An image display apparatus, according to Embodiment 4 of the present invention, whose basic configuration is the same as that of Embodiment 2 has features in that, in the gray-scale level-conversion in the backlight-luminance calculator, an evaluation value is calculated for the luminance "I" of the backlight light source, in accordance with not only one gray-scale-level-conversion-rule but also a plurality of gray-scale-level-conversion-rules so that the backlight-luminance and the gray-scale-level-conversion-rule are determined, and in that an input video image is converted by utilizing a gray-scale level-conversion by the determined gray-scale-level-conversion-rule and then is transmitted to a liquid-crystal panel 46.

Figure 16:
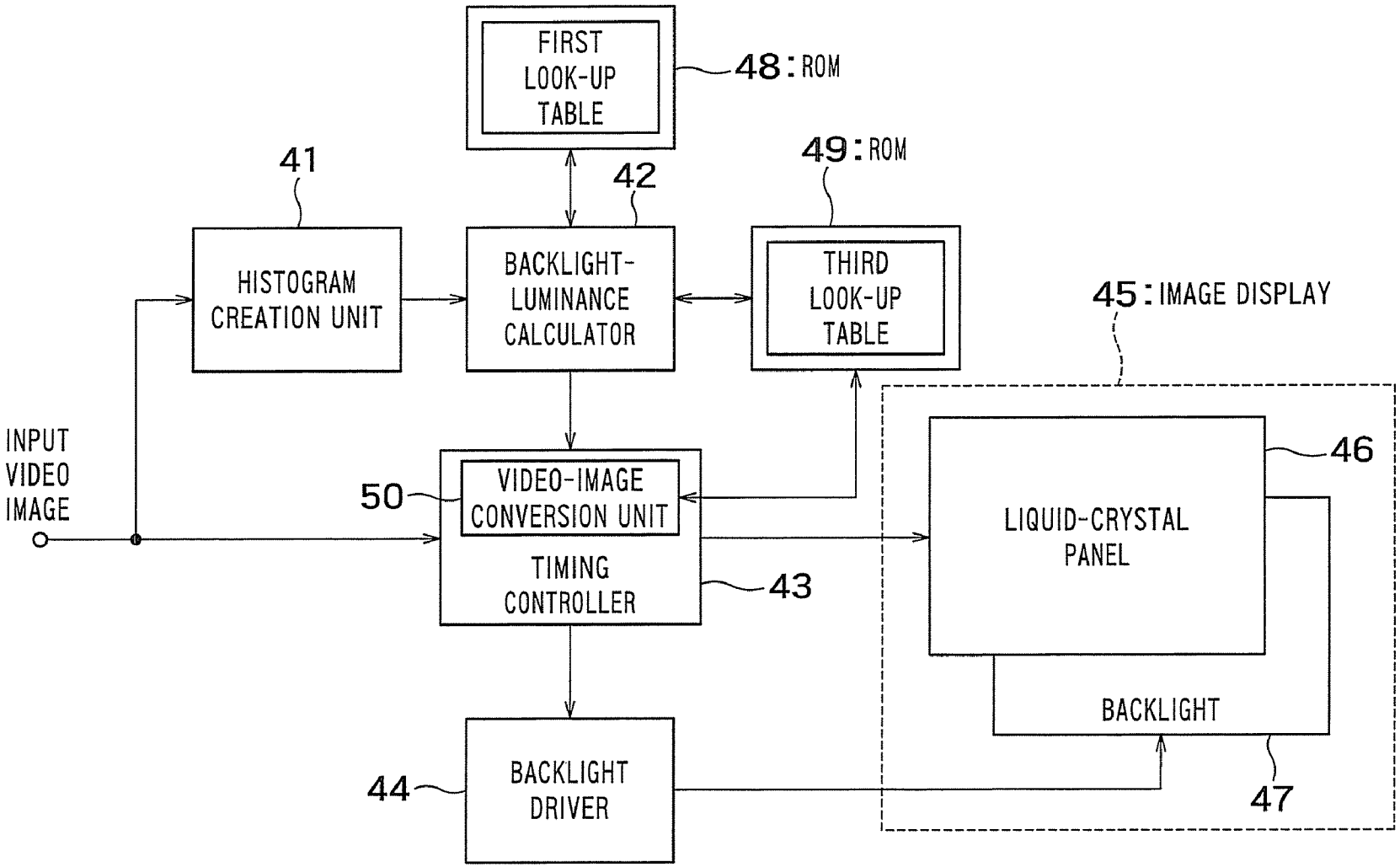
FIG. 16 is a diagram illustrating the configuration of an image display apparatus according to Embodiment 4.

FIG. 16 is a diagram illustrating the configuration of an image display apparatus according to Embodiment 4 of the present invention.

FIG. 16 illustrates approximately the same configuration as that of Embodiment 2; however, the second look-up table in Embodiment 2 is replaced by a third look-up table in which retained data items are different from one another. As is the case with Embodiment 2, an input video image is inputted to a histogram creation unit 41 and a timing controller 43, and a histogram is created in the histogram creation unit 41. With reference to a first look-up table in which a gray-scale level vs. brightness characteristic is retained and the third look-up table in which a plurality of gray-scale-level-conversion-rules are retained, the backlight-luminance calculator 42 calculates the backlight-luminance and transmits the calculated backlight-luminance to a timing controller 43. The timing controller 43 adjusts the synchronization between the input video image and the luminance of the backlight, calculated by the backlight-luminance calculator 42, and in the video-image conversion unit 50, applies a gray-scale level-conversion to the input video image, with reference to the third look-up table. The input video image converted by the gray-scale level-conversion in the video-image conversion unit 50 is transmitted, along with a synchronization signal for driving a liquid-crystal panel 46, to the liquid-crystal panel 46; the luminance of the backlight is transmitted to a backlight driver 44. Based on the inputted backlight luminance, the backlight driver 44 creates a backlight drive signal, for actually driving and controlling a backlight, which is transmitted to the backlight 47. In the last place, the input video image converted by the gray-scale level-conversion is written in the liquid-crystal panel 46; at the same time, based on the backlight drive signal outputted from the backlight driver 44, the backlight 47 emits light, so that an image is displayed on the liquid-crystal panel 46.

The backlight-luminance calculator 42, which makes the configuration of the present embodiment different from that of Embodiment 2, and the video-image conversion unit 50 will be explained in detail below. In addition, other configurations are the same as those in Embodiment 2; therefore, explanations for them will be omitted.

(Backlight-Luminance Calculator 42)

Figure 17:
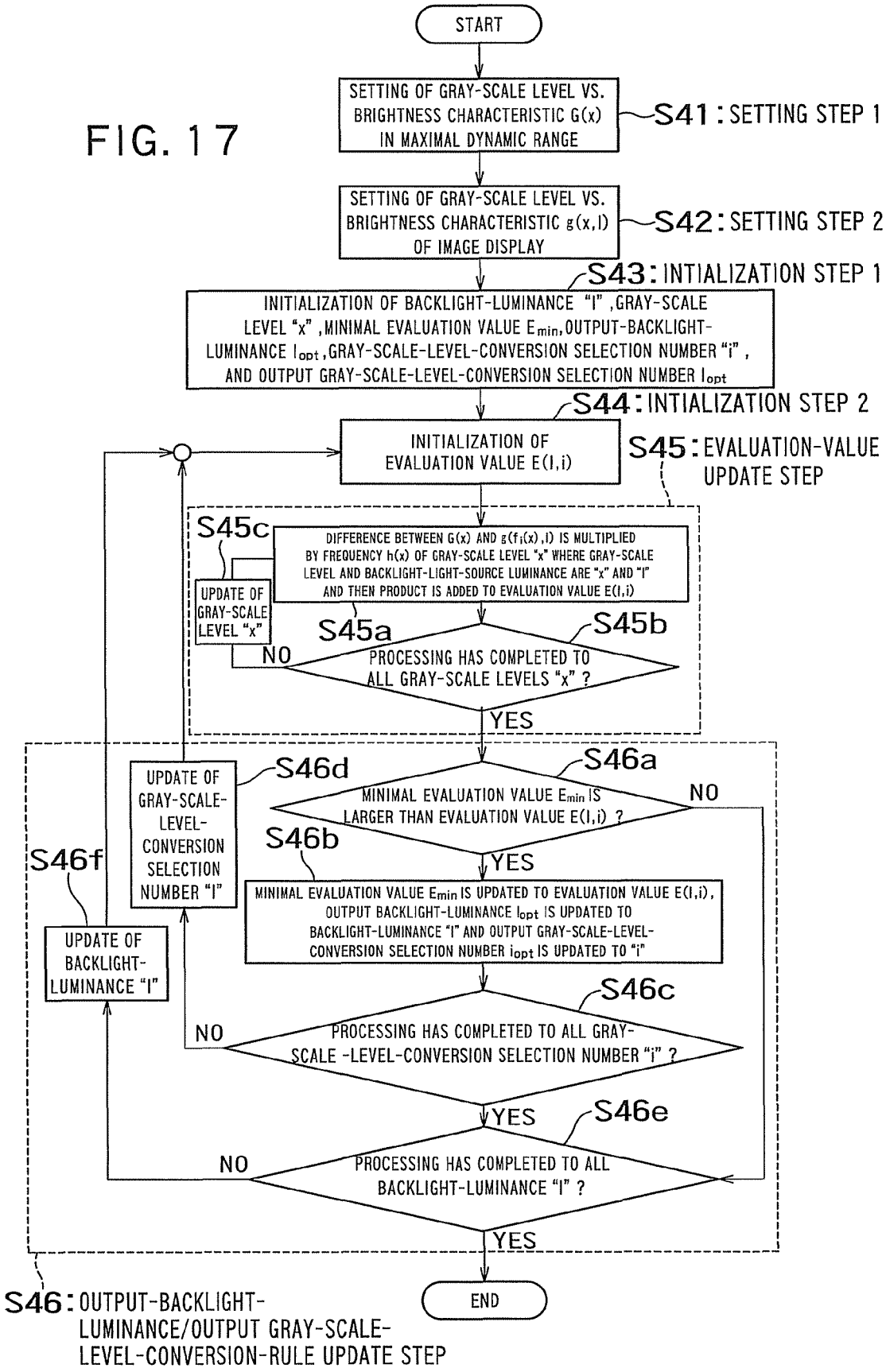
FIG. 17 is a flowchart for explaining the operation of a backlight-luminance calculator in Embodiment 4.

The processing in the backlight-luminance calculator 42 is the same as that in Embodiment 2 in terms of the basic flow, and in Embodiment 2, a plurality of backlight-luminances is evaluated so as to select the backlight-luminance, which brings about an optimal value; however, the present embodiment is different from Embodiment 2 in that respective combinations of a plurality of backlight-luminances and a plurality of gray-scale-level-conversion-rules are evaluated so as to select the combination, of the backlight-luminance and the gray-scale-level-conversion-rule, which brings about an optimal value. The operation of the backlight-luminance calculator 42 in the present embodiment will be explained in detail, with reference to a flowchart illustrated in FIG. 17.

The setting steps 1 (S41) and 2 (S42) are the same as those in Embodiment 1.

Figure 18:
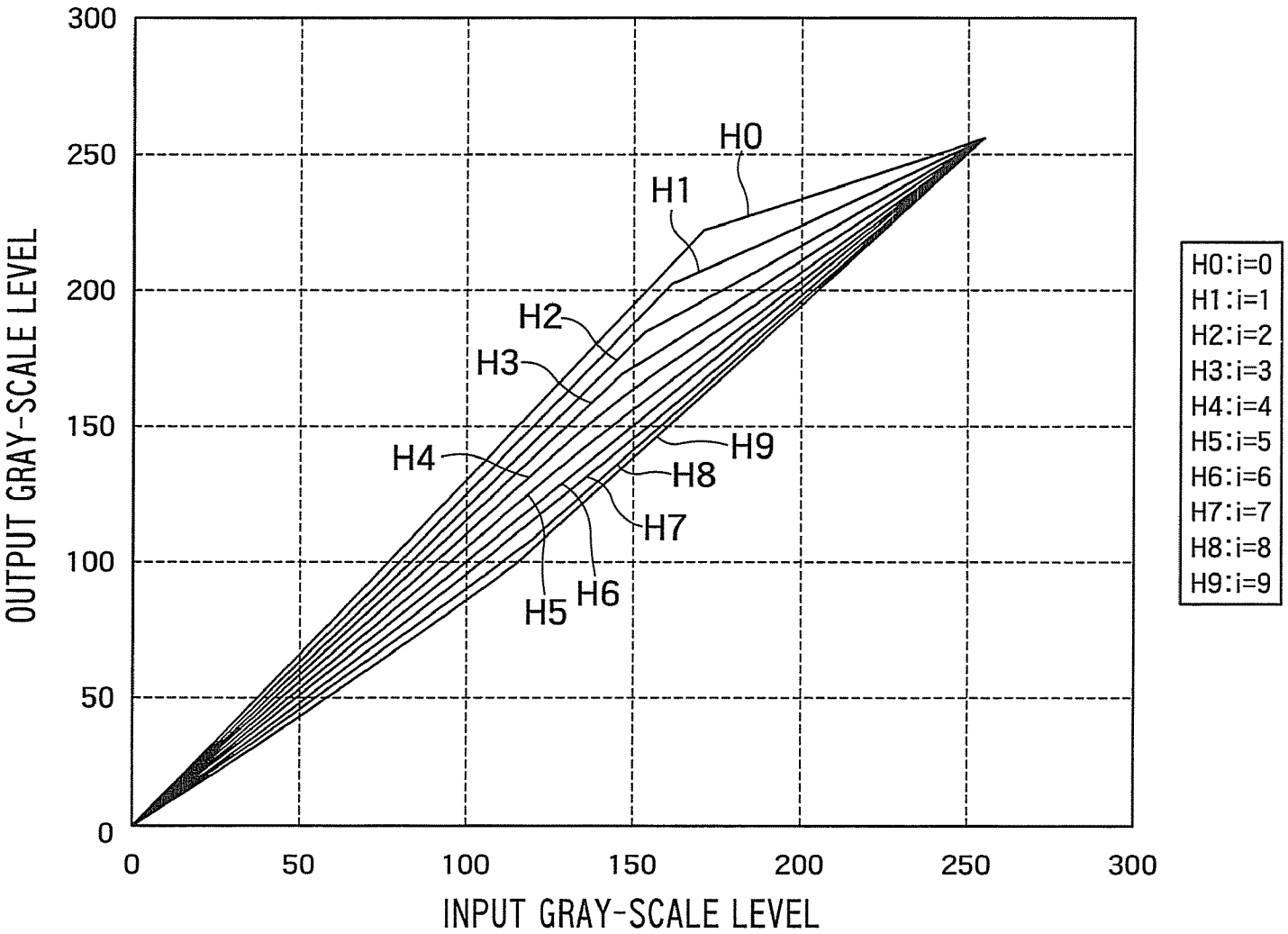
FIG. 18 is a graph representing ten kinds of gray-scale-level-conversion-rules.

The basic configuration of the initialization step 1 (S43) is the same as that of the initialization step 1 in Embodiment 1; however, in the present embodiment, the processing represented by Formula 26 is added to the initialization step 1 represented by Formula 14.

$$i \leftarrow 0$$

$$i_{opt} \leftarrow i \qquad \text{[Formula 26]}$$

where "i" is a gray-scale-level-conversion selection number for selecting one of the gray-scale-level-conversion-rules f(x) set in plurality for the input gray-scale level "x". In the present embodiment, ten kinds of gray-scale-level-conversion-rules, represented in FIG. 18, are set. In addition, as represented in FIG. 18, the gray-scale-level-conversion-rule may be configured in such a way as not to depend on the luminance "I" of the backlight light source; however, a plurality of gray-scale-level-conversion-rules, which differ from one another in accordance with the luminance "I" of the backlight light source, may be set. In that case, the gray-scale-level-conversion-rule is represented as a function $f_i(x, I)$ of the gray-scale level "x" and the luminance "I" of the backlight light source. Additionally, the gray-scale level-conversion $f_i(x)$ can be obtained through calculation in the backlight-luminance calculator 42; however, in the present embodiment, the configuration is in such a way that table data, in which the input gray-scale level "x" and the output gray-scale level $f_i(x)$ are related to each other, is retained, as the third look-up table, in a ROM 49. FIG. 19 is an example of the third look-up table. In the evaluation-value update step (S45) described later, by, with regard to the current gray-scale level "x" and the gray-scale-level-conversion selection number referring to the third look-up table, the output gray-scale level $f_i(x)$ is obtained.

In the initialization step 2 (S44), the evaluation value E(I, i) to be utilized in the evaluation-value update step (S45) is initialized as represented in Formula 27.

$$E(I,i) \leftarrow 0 \qquad \text{[Formula 27]}$$

In the evaluation-value update step (S45), as is the case with Embodiment 2, by utilizing the luminance "I" of the backlight light source and the gray-scale-level-conversion-rule $f_i(x)$ selected based on the gray-scale-level-conversion selection number "i", the evaluation value E(I, i) is calculated (S45*a*). For example, in the case where the brightness and the difference are represented by the luminance and the squared error, respectively, the update of the evaluation value, for each gray-scale level "x", is represented as in Formula 28.

$$E(I,i) \leftarrow E(I,i) + \{G(x) - g(f_i(x), I)\}^2 h(x) \qquad \text{[Formula 28]}$$

By applying the processing in Formula 28 to all the gray-scale levels "x", the evaluation value E(I, i) in the case where the backlight-luminance is "I" and the gray-scale-level-conversion-rule is $f_i(x)$ is calculated (S45*b* and S45*c*).

In Embodiment 2, only the luminance "I" of the backlight light source is evaluated; however, in the output-backlight-luminance update/output-gray-scale-level-conversion-rule update step (S46) in the present embodiment, the combination of the luminance "I" of the backlight light source and the gray-scale-level-conversion-rule $f_i(x)$ is evaluated. In the first place, it is determined whether or not the evaluation value E(I, i), at the current luminance "I" of the backlight light source and the gray-scale-level-conversion-rule $f_i(x)$, obtained in the evaluation-value update step (S45) is smaller than the minimal evaluation value $E_{min}$ (S46*a*); when the evaluation value E(I, i) is smaller than the minimal evaluation value $E_{min}$ (YES), the current luminance "I" of the backlight light source is considered to be the luminance $I_{opt}$ of the output backlight light source, the gray-scale-level-conversion selection number "i" that indicates the current gray-scale-level-conversion-rule $f_i(x)$ is considered to be $i_{opt}$, and then the minimal evaluation value $E_{min}$ is updated to the current evaluation value E(I, i) (S46*b*). Next, it is determined whether or not the evaluation has been performed for all the preliminarily set gray-scale-level-conversion selection numbers (S46*c*); when the evaluation of the gray-scale-level-conversion-rule has not been performed for all the preliminarily set gray-scale-level-conversion selection numbers (NO), one is added to "i" so as to update the gray-scale-level-conversion-rule (S46*d*). When the evaluation has been performed for all the preliminarily set gray-scale-level-conversion selection numbers (YES), it is also determined whether or not the evaluation has been performed for all the preliminarily set luminances "I" of the backlight light source (S46*e*), and when the evaluation for all the preliminarily set luminances "I" of the backlight light source has not been performed (NO), the luminance "I" of the backlight light source is updated (S46*f*) and the initialization step 2 (S44) is resumed. In the case where the evaluation for all the preliminarily set luminances of the backlight light source has been performed (YES), the current output-backlight-luminance $I_{opt}$ and the output gray-scale-level-conversion selection number $i_{opt}$ are outputted from the backlight-luminance calculator 42.

(Video-Image Conversion Unit 50)

As is the case with Embodiment 2, the video-image conversion unit 50 applies a gray-scale level-conversion to each of the gray-scale levels of the pixels in an input video image, by utilizing that gray-scale level and the output gray-scale-level-conversion selection number, calculated in the backlight-luminance calculator 42, so as to refer to the third look-up table. In other words, the processing in accordance with Formula 29 is applied to the gray-scale level L(u, v), in the input video image, at the horizontal pixel position "u" and the vertical pixel position "v".

$$L_{out}(u,v) = f_{i_{opt}}(L(u,v)) \qquad \text{[Formula 29]}$$

where $L_{out}(u, v)$ is the converted gray-scale level of the pixel, in the input video image, at the position (u, v). By applying the processing in accordance with Formula 29 to all the pixels in one frame of the input video image, the input video image is converted, and while being synchronized with the backlight-luminance signal, the converted input video image is transmitted to the liquid-crystal panel 46.

As described heretofore, according to the present embodiment, an image display apparatus which is excellent in visual contrast and whose power consumption is reduced can be provided.

Embodiment 5

An image display apparatus, according to Embodiment 5 of the present invention, whose basic configuration is the same as that of Embodiment 1 has a feature in that histograms for a plurality of past frames are retained in the histogram creation unit, and a histogram, which is a sum of a histogram for the current input video image and the histograms for a plurality of past frames, is created.

Figure 20:
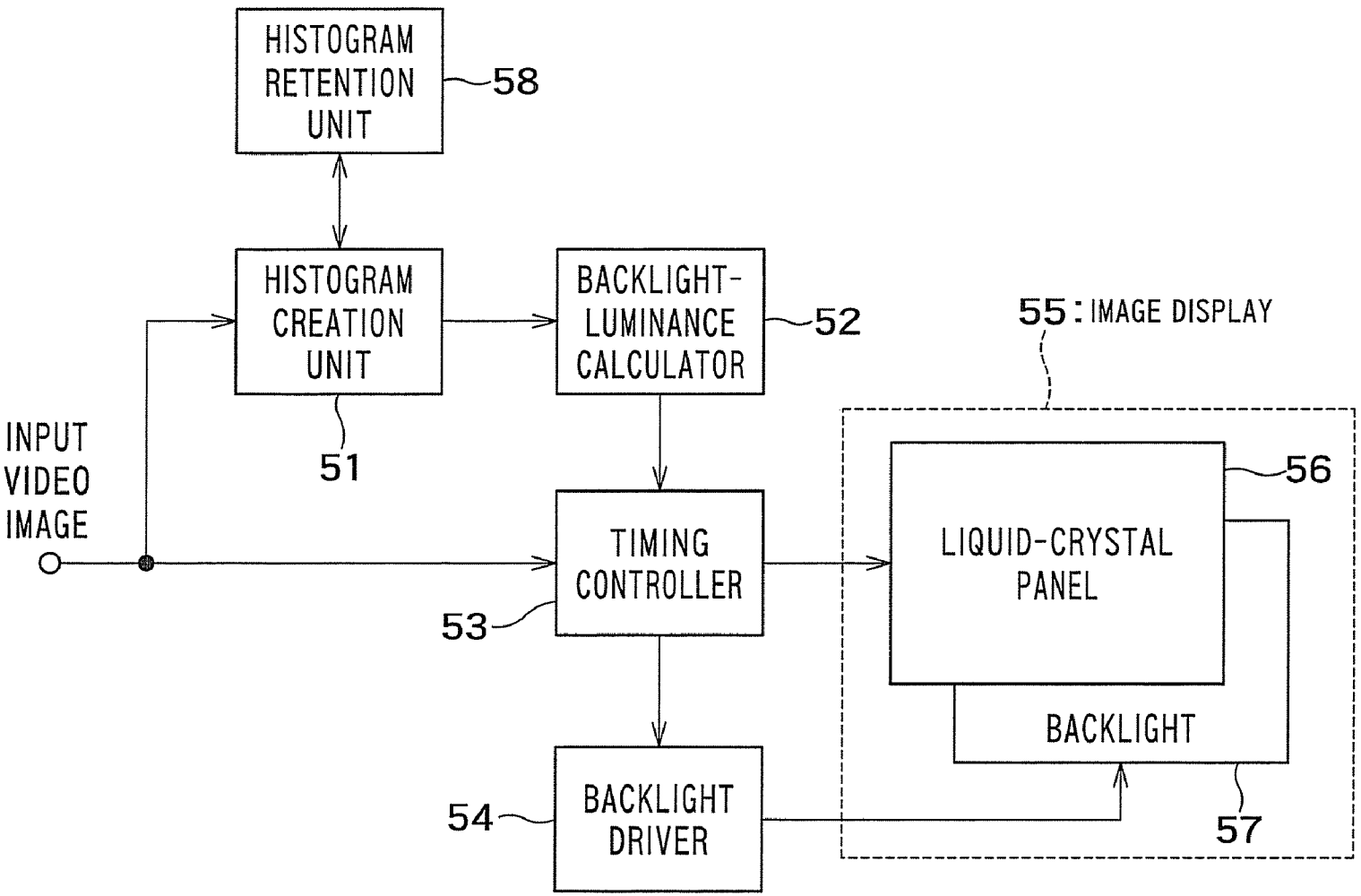
FIG. 20 is a diagram illustrating the configuration of an image display apparatus according to Embodiment 5.

FIG. 20 is a diagram illustrating the configuration of an image display apparatus according to Embodiment 5 of the present invention. The basic configuration of the image display apparatus in FIG. 20 is the same as that in the case of Embodiment 1; however, a histogram retention unit 58 is further added. Because constituent elements 52 to 57 other than a histogram creation unit 51 are the same as those in Embodiment 1, explanations for them will be omitted; in the present embodiment, the operation of the histogram creation unit 51 will be explained in detail.

(Histogram Creation Unit 51)

The operation of the histogram creation unit 51 according to the present embodiment, which is basically the same as that in the case of Embodiment 1, has a feature in that histograms for a plurality of past frames are retained in the histogram retention unit 58, and the histogram creation unit 51 outputs to a backlight-luminance calculator 52 a temporally accumulated histogram obtained by adding the histogram for the current input video image and the histograms for a plurality of past frames.

Figure 21:
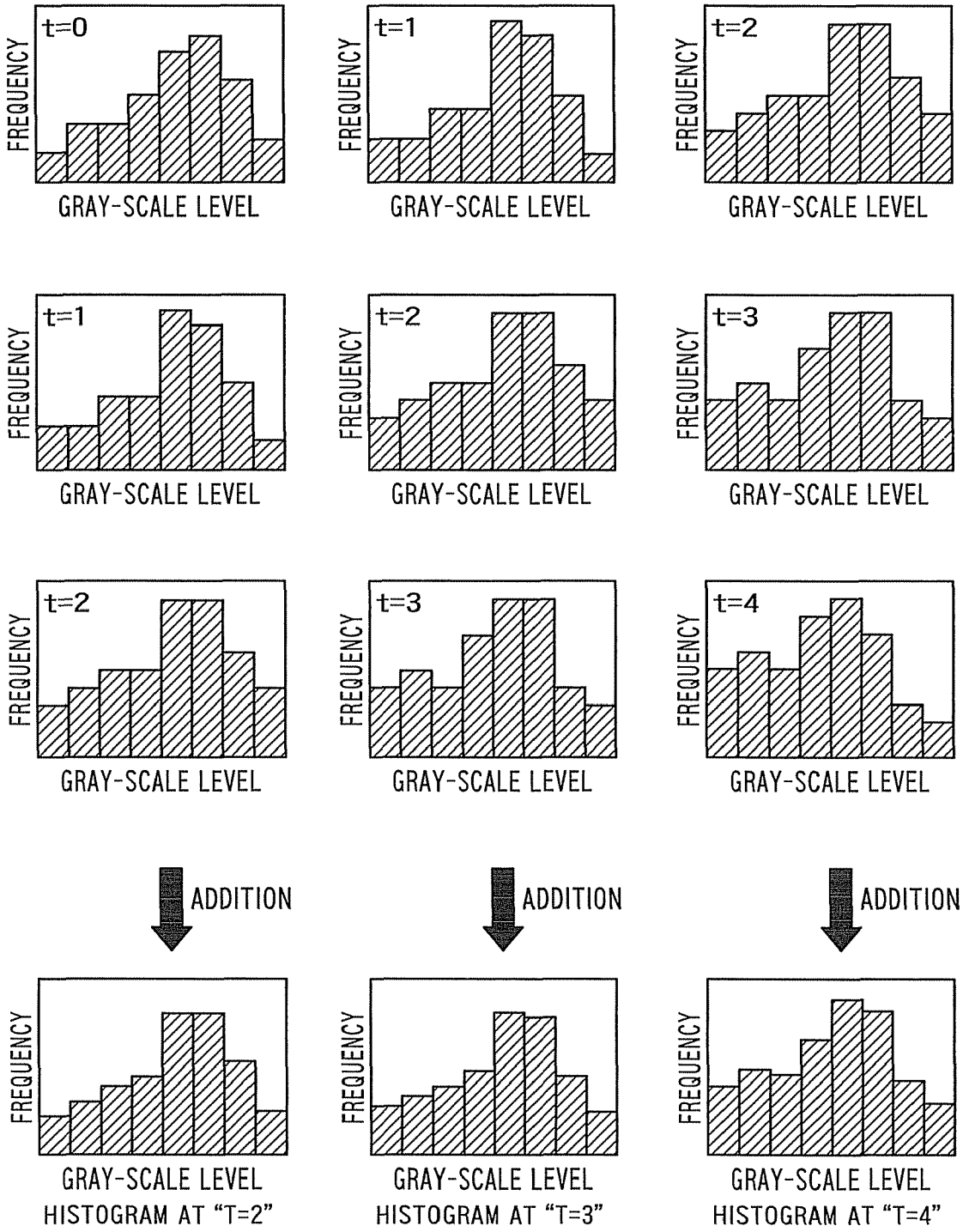
FIG. 21 is a set of graphs for explaining a creation process for a temporally accumulated histogram.
Figure 22:
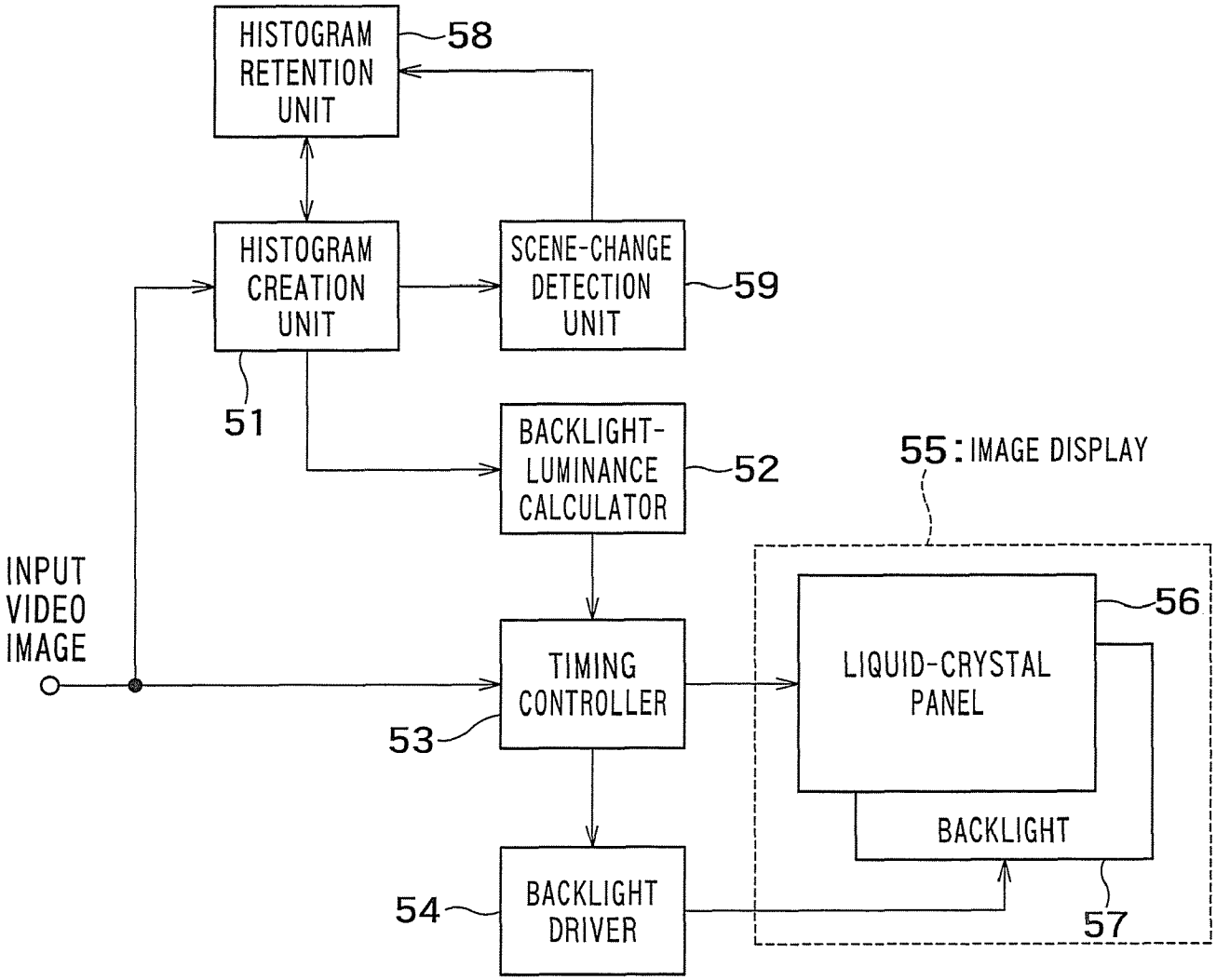
FIG. 22 is a diagram obtained by adding a scene-change detection unit to the image display apparatus in FIG. 20.
Figure 23:
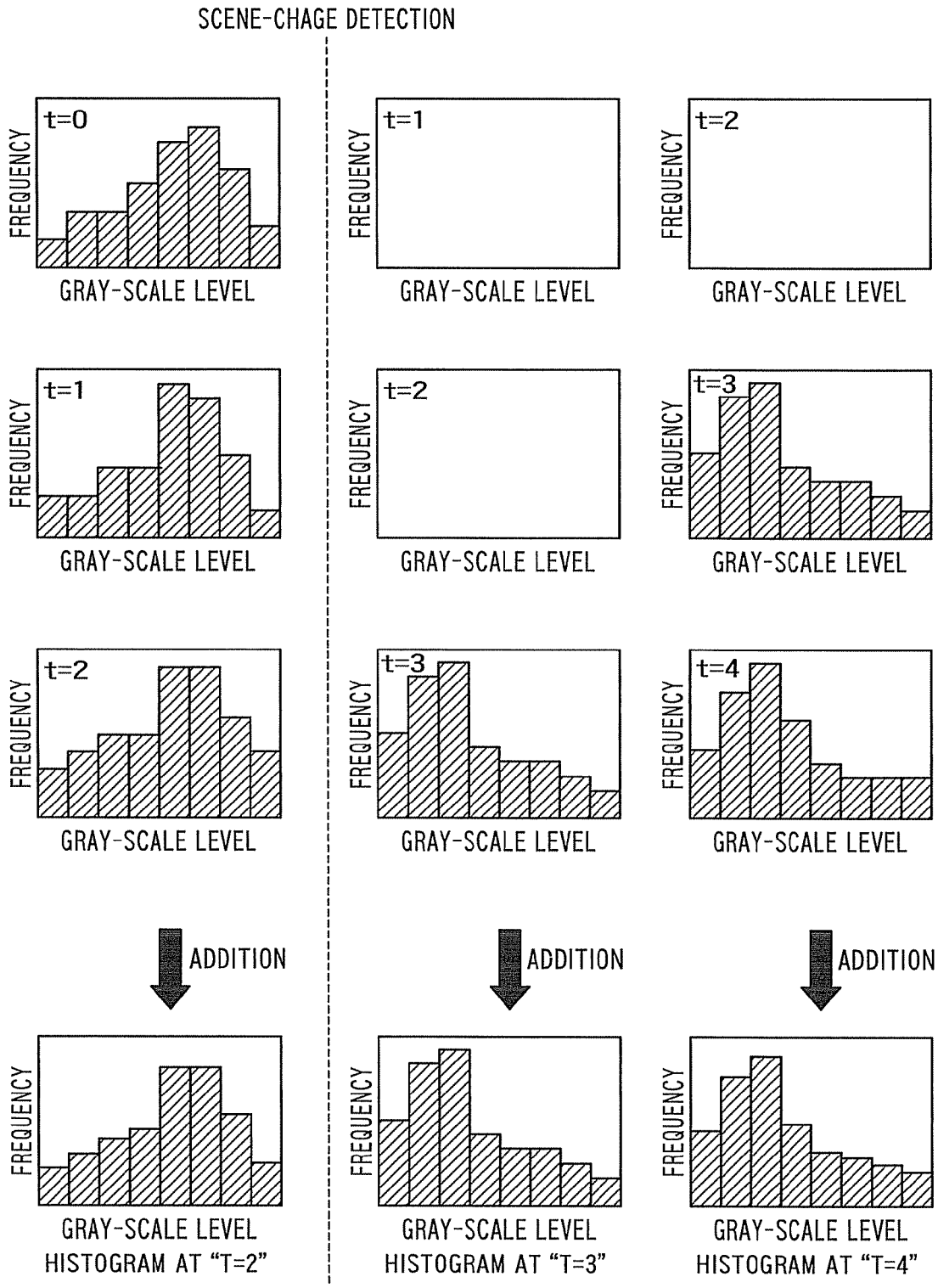
FIG. 23 is a set of graphs for explaining the operation of a histogram creation unit utilizing scene-change detection.

A creation process for the temporally accumulated histogram will be explained with reference to FIG. 21. FIG. 21 represents respective histograms, at the time instants t=2 to t=4, outputted from the histogram creation unit 51. In Embodiment 1, the histogram outputted at the time instant t=2 is the histogram, at the time instant t=2, of the input video image; however, in the present embodiment, the histograms at the time instants t=0 and t=1, for the past two frames are retained in the histogram retention unit 58; at the time instant t=2, the temporally accumulated histogram obtained by adding the respective histograms at the time instants t=0, t=1, and t=2 is outputted. In addition, the ordinate scale of the temporally accumulated histogram is different from that of the respective histograms at the time instants t=0, t=1, and t=2. At the time instant t=3, the temporally accumulated histogram obtained by adding the respective histograms at the time instants t=1, t=2, and t=3 is outputted; thereafter, the same processing is repeated. In the present embodiment, the configuration is in such a way that histograms for past two frames are retained in the histogram retention unit 58; however, the configuration may be in such a way that histograms for a greater number of past frames are retained. In this regard, however, in the case where, with a great number of histograms for past frames retained, a great change in the histogram occurs, it takes a considerably long time until the change is reflected in the temporally accumulated histogram; as a result, the calculation of the backlight-luminance may be performed by use of a histogram that considerably differs from the current input video image. Thus, in particular, in the case where histograms for a great number of past frames are retained, it is preferable that the configuration is in such a way that, as illustrated in FIG. 22, a scene-change detection unit 59 for detecting a change in video-image scenes (scene change) is further provided, and in the case where the scene-change detection unit 59 detects a scene change, the histograms, for past frames, retained in the histogram retention unit 58 are reset (all the frequencies are made to be zero). The method of detecting a scene change by the scene-change detection unit 59 can be devised in various manners; however, in the present embodiment, the method is in such a way that the detection is performed by use of a histogram detected from two frames that are temporally adjacent to each other. Letting h(x, t) denote the frequency, at the time instant "t", of the gray-scale level "x", the scene change is detected by use of formula 30.

$$s(t) = \begin{cases} 1 & \sum_{x=0}^{255} |h(x,t) - h(x,t-1)| > T_s \\ 0 & \text{otherwise} \end{cases} \quad \text{[Formula 30]}$$

where s(t) denotes the result of scene-change detection at the time instant "t", and "1" denotes that a scene change exists and "0" denotes that no scene change exists. "$T_s$" is a threshold value for determining whether or not a scene change exists. The operation of the histogram creation unit 51 utilizing scene-change detection will be explained with reference to FIG. 23. FIG. 23 represents how the histogram creation unit 51 operates in the case where a scene change is detected between the time instants t=2 and t=3. The histogram outputted at the time instant t=2 is a histogram obtained by adding the respective histograms at the time instants t=0, t=1, and t=2 as described above. After that, when a scene change is detected based on the histograms for the input video image at the time instant t=2 and the histograms for the input video image at the time instant t=3, the histograms, at the time instants t=1 and t=2, for the past frames retained in the histogram retention unit 58 are reset, i.e., all the frequencies are cleared to zero. As a result, the histogram outputted at the time instant t=3 is not affected by the histograms at the time instants t=1 and t=2, i.e., before the scene change. Subsequently, at the time instant t=4, a histogram obtained by adding the respective histograms at the time instants t=2, t=3, and t=4 is outputted; however, because the histogram at the time instant t=2, i.e., before the scene change has been reset, the histogram obtained by adding the respective histograms at the time instants t=2, t=3, and t=4 is not affected by the histograms before the scene change.

As discussed above, by utilizing a temporally accumulated histogram obtained by adding the histograms for past frames so as to calculate the backlight-luminance, it is made possible to keep the backlight-luminance from excessively fluctuating in response to a small change of an input video image, due to noise or a motion in the input video image. As a result, it is made possible to suppress a flicker, caused on the image display, due to excessive fluctuation of the backlight-luminance.

As described heretofore, according to the present embodiment, an image display apparatus which is excellent in visual contrast and whose power consumption is reduced can be provided.

Embodiment 6

An image display apparatus, according to Embodiment 6 of the present invention, whose basic configuration is the same as that of Embodiment 1 has a feature in that, in the backlight-luminance calculator, limitations are placed on fluctuation, of the backlight-luminance, between frames. The present embodiment is the same as Embodiment 1 except that the processing in the backlight-luminance calculator is expanded; therefore, the present embodiment will be explained below with reference to FIGS. 1 to 4 utilized in the discussion in embodiment 1.

In the backlight-luminance calculator 12 according to the present embodiment, as is the case with Embodiment 1, the output-backlight-luminance $I_{opt}$ is calculated. After that, in accordance with the processing represented in Formulas 31 and 32, limitations are placed on the fluctuation, in the backlight-luminance, between frames.

$$I_{opt}(t) = \begin{cases} I_{opt}(t-1) + \mathrm{sgn}(I_{opt}(t) - I_{opt}(t-1))T_l & |I_{opt}(t) - I_{opt}(t-1)| > T_l \\ I_{opt}(t) & \text{otherwise} \end{cases} \quad \text{[Formula 31]}$$

In this regard, however, $$\mathrm{sgn}(a) = \begin{cases} -1 & a < 0 \\ 1 & a > 0 \\ 0 & a = 0 \end{cases} \quad \text{[Formula 32]}$$

Figure 24:
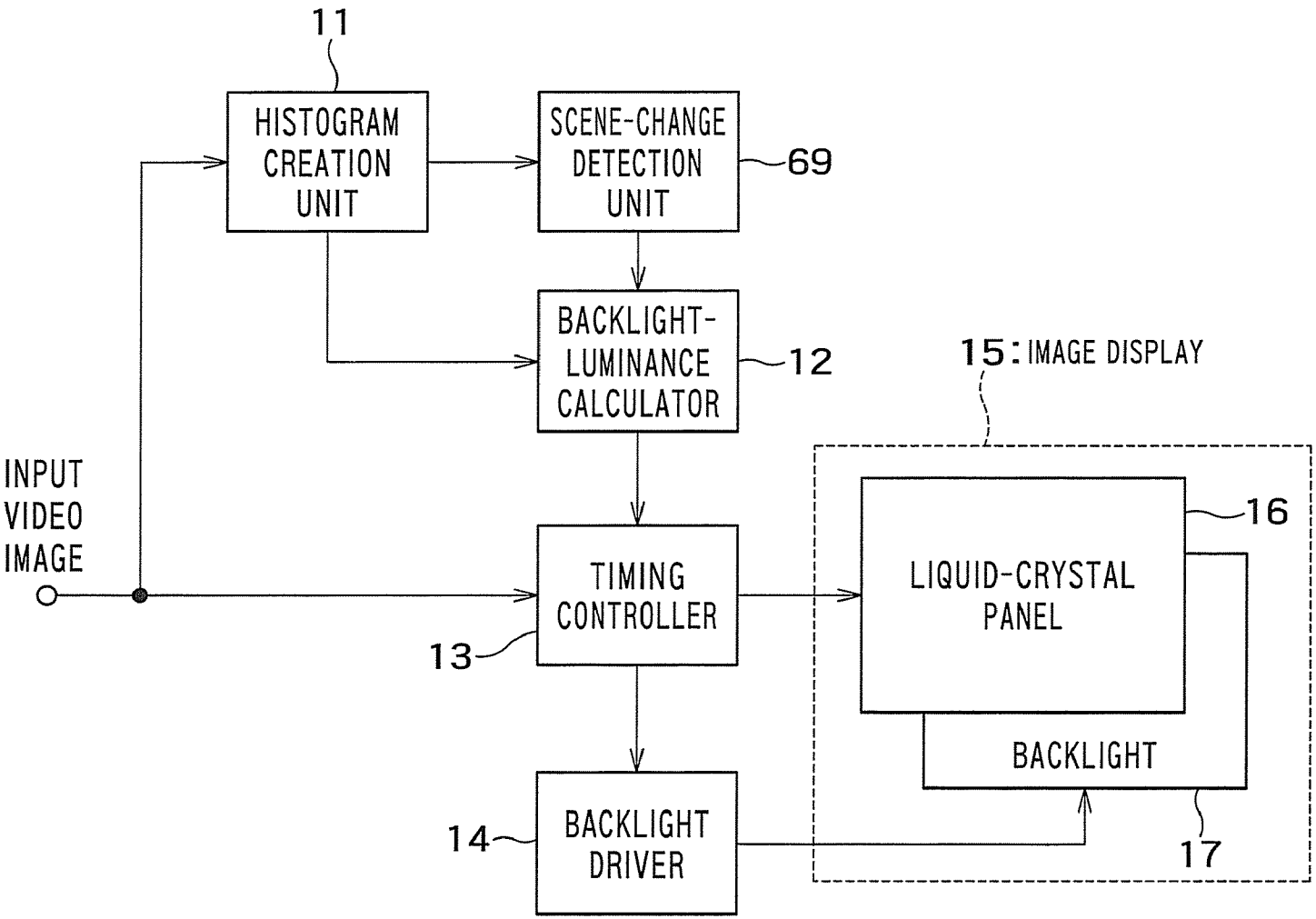
FIG. 24 is a diagram illustrating the configuration of an image display apparatus according to Embodiment 6.

Here $I_{opt}(t)$ denotes the output-backlight-luminance at the time instant "t", and "$T_l$" denotes the limitation range of the fluctuation. In other words, Formula 31 represents that, in the case where the change in the backlight-luminance between frames exceeds "$T_l$", the change amount is limited to "$T_l$". By performing the foregoing processing, it is made possible to limit a large change, between frames of an input video image, in the backlight-luminance; as a result, it is made possible to suppress a flicker, caused on the image display 15, due to excessive fluctuation of the luminance of the backlight light source. However, with the foregoing configuration, also in the case where, due to a scene change or the like, a displayed video image considerably changes between the frames, the amount of the change in the backlight-luminance is limited; as a result, the change in the backlight-luminance may largely be delayed with respect to the displayed video image. Therefore, it is desirable that, as illustrated in FIG. 24, a scene-change detection unit 69 is provided, and based on the result of scene change detection, the fluctuation amount, between the frames, of the backlight-luminance is controlled. In the present embodiment, by utilizing the result of the detection in accordance with the scene-change detection method (represented in Formula 30) configured in the same manner as in Embodiment 5, the limitation range $T_l$ is controlled as follows:

$$T_l(t) = \begin{cases} T_l & s(t) = 0 \\ \beta T_l & \text{otherwise} \end{cases} \quad \text{[Formula 33]}$$

where "β" is a positive real number that is larger than one, and $T_l(t)$ is the limitation range, at the time instant "t", of the amount of change, between the frames, in the backlight-luminances. That is to say, in the case where no scene change exists (s(t)=0), the limitation range $T_l$ that is the same as that represented in Formula 31 is utilized; in the case where a scene change exists (s(t)=1), a limitation range, obtained by multiplying the limitation range $T_l$ by the coefficient "β", which is larger than $T_l$ is utilized. In the case where the change in the backlight-luminance is large when the scene changes, it is made possible to make the change in the backlight-luminance follow the scene change, by utilizing the limitation range $T_l(t)$ obtained in accordance with Formula 33 so as to perform the processing represented in Formula 31.

In addition, in the present embodiment, the configuration is in such a way that, after the output-backlight-luminance for an input video image is calculated, the temporal change in the backlight-luminance is limited; however, other configurations can also be devised. For example, in Embodiment 1, throughout the backlight-luminance modulation range from $I_{min}$ to $I_{max}$, the evaluation value E(I) is calculated in the output-backlight-luminance update step (S16 in FIG. 4), and then the output-backlight-luminance is determined; however, the configuration is in such a way that backlight-luminance to be evaluated is limited to the vicinity of the one-frame-previous output-backlight-luminance, so that an excessive change, between the frames, in the output-backlight-luminance can be limited. In other words, in Embodiment 1, in substitution for the initial value of the backlight-luminance "I", at the time instant "t", in the initialization step 1 (S13), $I_{min}$ is set; however, in the present embodiment, a modification is implemented as follows:

$$I \leftarrow I_{opt}(t-1) - T_l \quad \text{[Formula 34]}$$

where $I_{opt}(t-1)$ denotes the output-backlight-luminance at the time instant t−1. In this regard, however, in the case where "I" is smaller than $I_{min}$, "I" is changed to $I_{min}$. Additionally, in the determination (S16*c*), in the output-backlight-luminance update step (S16), whether or not the processing throughout the backlight-luminance modulation range has been completed, it is determined, in Embodiment 1, whether or not "I" is smaller than the maximal value $I_{max}$ of the modulation range; however, in the present embodiment, the configuration is modified to be in such a way that it is determined whether or not "I" is smaller than $I_{opt}(t-1)+T_l$ and smaller than $I_{max}$, when "I" is smaller than $I_{opt}(t-1)+T_l$ and smaller than $I_{max}$, the backlight-luminance is updated (S16*d*) and the initialization step 2 (S14) is resumed, and when "I" is not smaller than $I_{opt}(t-1)+T_l$ and smaller than $I_{max}$, the processing is ended. With the foregoing configuration, the backlight-luminance is evaluated only within a range, i.e., $\pm T_l$ with respect to the output-backlight-luminance $I_{opt}(t-1)$ for the previous frame; therefore, the output-backlight-luminance $I_{opt}(t)$ is determined also in such a way as to fall within the range. As a result, the temporal change in the output-backlight-luminance can be limited. In addition, also in the foregoing configuration, the scene-change detection can be integrated; in that case, the configuration may be in such a way that $T_l(t)$ is obtained in accordance with Formula 33.

Figure 25:
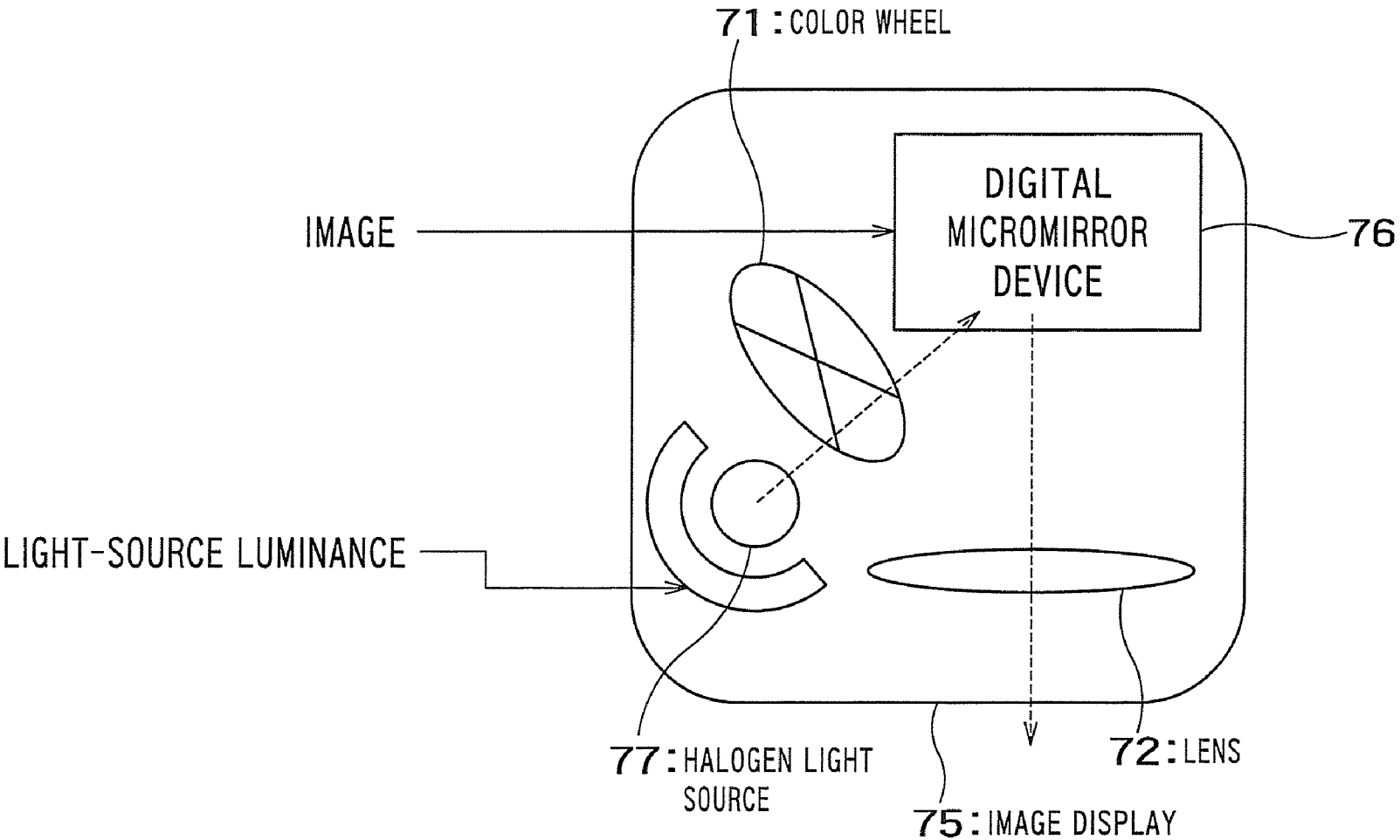
FIG. 25 is a diagram illustrating an example of a projection-type image display utilizing a digital micromirror device.

Heretofore, the embodiments of a transmission-type liquid crystal display apparatus, in which, as the image display, a liquid-crystal panel and a backlight are combined, have been explained; however, the present invention can be applied not only to a transmission-type liquid crystal display apparatus but also to configurations of various image displays. For example, the present invention can be applied also to a projection-type image display in which a liquid-crystal panel as the light modulation device and a light source such as a halogen light source are combined. Moreover, the present invention may be applied also to a projection-type image display in which a halogen light source and a digital micromirror device for displaying an image by controlling the reflection of light from the halogen light source are utilized as the light source and as the light modulation device, respectively. FIG. 25 is a diagram illustrating an example of a projection-type image display utilizing a digital micromirror device.

A color wheel 71 for rendering colors is disposed between a halogen light source 77 and a digital micromirror device 76, i.e., on the optical axis of a light source that emits white light. The color wheel 71 is divided into areas that make the respective colors of light beams transmitted through the corresponding areas red, green, and blue. When the color wheel 71 on the optical axis of the light source is red, the color of light, from the light source, that reaches the digital micromirror device 76 becomes red; at the same time, the red-component image of an input image is displayed on the digital micromirror device 76. The light reflected by the digital micromirror device 76 is outputted by way of a lens 72. Similarly hereinafter, by applying the foregoing operation also to green and blue and considerably rapidly switching the operation among the colors, a color image is displayed.

What is claimed is:

1. An image display apparatus comprising:

an image display which includes a light source whose light-source luminance is adjustable;

a light modulation device that displays an image by modulating a transmittance or a reflectance of light from the light source, based on signals representing the image;

a histogram creation unit configured to create a histogram from one frame of an input video image, the histogram indicating frequencies of pixels included in level-ranges associated with representative gray-scale levels;

a light-source-luminance calculator which includes:

a difference calculation unit that calculates differences between first brightnesses, each predetermined for the each representative gray-scale level, and second brightnesses, each preliminarily obtained for the each representative gray-scale level displayed on the image display with each of a plurality of light-source levels of the light-source luminance;

a difference accumulating unit that accumulates, for each of the representative gray-scale levels, products of the differences by the frequencies of pixels included in level-ranges associated with representative gray-scale levels;

a light-source-luminance selection unit that selects a light-source level having the smallest accumulated sum or the smaller accumulated sum than a threshold value;

and a control unit configured to provide signals of the one frame of the input video image to the light modulation device and control the light modulation device so that the light source emits light in luminance corresponding to the selected light-source level.

2. The apparatus according to claim 1, wherein the brightness is one of relative luminance to luminance of the image display obtained when the light source is set to a maximal light-source level, relative lightness to lightness of the image display obtained when the light source is set to the maximal light-source level, and relative logarithmic luminance to logarithmic luminance of the image display obtained when the light source is set to the maximal light-source level.

3. The apparatus according to claim 1, wherein the difference is one of an absolute value of the difference between the first brightness the and second brightness and a squared value of the difference between the first brightness and the second brightness.

4. The apparatus according to claim 1, wherein the histogram creation unit utilizes as the frequency of the pixels a value obtained by raising the frequency of the pixels to an $\alpha$-th power ($\alpha$ is a positive real number that is larger than zero).

5. The apparatus according to claim 1, wherein the difference accumulating unit accumulates products of the differences by a value obtained by raising the frequency to an $\alpha$-th power ($\alpha$ is a positive real number that is larger than zero).

6. The apparatus according to claim 1, wherein the difference calculation unit calculates differences between the first brightnesses and the second brightnesses each preliminarily obtained for each converted representative gray-scale level acquired by converting the each representative gray-scale level in accordance with a predetermined gray-scale-level-conversion-rule, and the control unit gives to the light modulation device signals of an image obtained by converting the one frame of the input video image in accordance with the predetermined gray-scale-level-conversion-rule.

7. The apparatus according to claim 6, wherein respective different predetermined gray-scale-level-conversion-rules are provided correspondingly to the light-source levels.

8. The apparatus according to claim 7, wherein as a light-source level becomes smaller, the larger is a gradient of an output gray-scale level to an input gray-scale level at a lower gray-scale level side in the predetermined gray-scale-level-conversion-rule associated with the light-source level.

9. The apparatus according to claim 7, wherein as the light-source level becomes larger, the larger is a gradient of an output gray-scale level to an input gray-scale level at a higher gray-scale level side in the predetermined gray-scale-level-conversion-rule associated with the light-source level.

10. The apparatus according to claim 6, wherein a plurality of gray-scale-level-conversion-rules are provided for each of the light-source levels, the light-source-luminance selection unit selects a set of the light-source level and the gray-scale-level-conversion-rule whose sum is a predetermined threshold value or smaller, or minimal, among the sums calculated for each combination of the light-source levels and the gray-scale-level-conversion-rules, and the control unit gives to the light modulation device signals of an image obtained by converting the one frame of the input video image in accordance with selected gray-scale-level-conversion-rule.

11. The apparatus according to claim 6, wherein, the predetermined gray-scale-level-conversion-rule defines that gray-scale levels from a first gray-scale level at a predetermined distance with respect to a minimal gray-scale level to a second gray-scale level at a predetermined distance with respect to a maximal gray-scale level in the one frame of the input video image are expanded from a minimal gray-scale level to a maximal gray-scale level that can be displayed on the light modulation device.

12. The apparatus according to claim 6, further comprising a memory configured to retain table data in which the gray-scale levels and the converted gray-scale levels are related to each other, wherein the difference calculation unit obtains the converted gray-scale levels by referring to the table data.

13. The apparatus according to claim 1, further comprising a memory configured to retain table data in which the gray-scale levels and the first brightnesses are related to each other, wherein the difference calculation unit obtains the first brightnesses by referring to the table data.

14. The apparatus according to claim 1, further comprising a memory configured to retain table data in which, for each of the light-source levels, the gray-scale levels and the second brightnesses are related to each other, wherein the difference calculation unit gets the second brightnesses associated with each of the light-source levels by referring to the table data.

15. The apparatus according to claim 1, further comprising a memory configured to retain table data in which, for each of the light-source levels, the representative gray-scale levels and the differences between the first brightnesses and the second brightnesses, are related to each other, wherein the difference calculation unit obtains the differences by referring to the table data, based on the light-source level and the representative gray-scale levels.

16. The apparatus according to claim 1, wherein the histogram creation unit creates a histogram in which the frequencies associated with representative gray-scale levels different from an average value, a median value, or a modal value of gray-scale levels, calculated from the one frame of the input image are made to zero.

17. The apparatus according to claim 1, wherein the histogram creation unit includes a memory which retains histograms for a plurality of past frames and adds the histograms for the plurality of past frames to the histogram as of now.

18. The apparatus according to claim 17, further comprising a scene-change detection unit that detects a change in a video scene, wherein the histogram creation unit deletes the histograms for the plurality of past frames from the memory when the change in the video scene is detected.

19. The apparatus according to claim 1, wherein the light-source-luminance selection unit makes a correction in such a way that the selected light-source level falls within a first level range with respect to the light-source level selected for a video image input in a past by one frame.

20. The apparatus according to claim 19, further comprising a scene-change detection unit that detects a change in a video scene, wherein the light-source-luminance selection unit makes a correction in such a way that the selected light-source level falls within a second level range that is larger than the first level range when the change in the video scene is detected.

21. The apparatus according to claim 1, wherein the image display is a projection-type or a transmission-type liquid-crystal display, having a liquid-crystal panel as the light modulation device and the light source that irradiates light onto a front or a rear of the liquid-crystal panel.

22. The apparatus according to claim 21, wherein the light source are light emitting diodes.

23. The apparatus according to claim 1, wherein the image display is a projection-type display having a digital micro-mirror device as the light modulation device and the light source that irradiates light onto a front of the digital micro-mirror device.

24. The apparatus according to claim 23, wherein the light source are light emitting diodes.

25. An image display method comprising:

creating a histogram from one frame of an input video image, the histogram indicating frequencies of pixels included in level-ranges associated with representative gray-scale levels;

calculating differences between first brightnesses, each predetermined for the each representative gray-scale level, and second brightnesses, each preliminarily obtained for the each representative gray-scale level displayed on an image display with each of a plurality of light-source levels of light-source luminance;

accumulating, for each of the representative gray-scale levels, products of the differences by the frequencies of pixels included in level-ranges associated with representative gray-scale levels;

selecting a light-source level having the smallest accumulated sum or the smaller accumulated sum than a threshold value;

and providing signals of the one frame of the input video image to a light modulation device that displays an image by modulating a transmittance or a reflectance of light from a light source based on signals representing the image, and controlling the light modulation device so that the light source whose light-source luminance is adjustable emits light in luminance corresponding to the selected light-source level.

26. The method according to claim 25, wherein the calculating differences includes calculating differences between the first brightnesses and the second brightnesses each preliminarily obtained for each converted representative gray-scale level acquired by converting the each representative gray-scale level in accordance with a predetermined gray-scale-level-conversion-rule, and the providing includes providing to the light modulation device signals of an image obtained by converting the one frame of the input video image in accordance with the predetermined gray-scale-level-conversion-rule.

27. The method according to claim 26, wherein a plurality of gray-scale-level-conversion-rules are provided for each of the light-source levels, the selecting includes selecting a set of the light-source level and the gray-scale-level-conversion-rule whose sum is a predetermined threshold value or smaller, or minimal, among the sums calculated for each combination of the light-source levels and the gray-scale-level-conversion-rules, and the providing includes providing to the light modulation device signals of an image obtained by converting the one frame of the input video image in accordance with selected gray-scale-level-conversion-rule.

* * * * *